US010386154B2

(12) United States Patent
Kras et al.

(10) Patent No.: US 10,386,154 B2
(45) Date of Patent: Aug. 20, 2019

(54) AIR GUN WITH COCKING LINKAGE SHOE

(71) Applicant: Sig Sauer, Inc., Newington, NH (US)

(72) Inventors: Krzysztof J. Kras, Fremont, NH (US); Justin D. Heckert, Newmarket, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 15/991,236

(22) Filed: May 29, 2018

(65) Prior Publication Data

US 2018/0347937 A1 Dec. 6, 2018

Related U.S. Application Data

(60) Provisional application No. 62/512,455, filed on May 30, 2017.

(51) Int. Cl.

| | |
|---|---|
| ***F41B 11/00*** | (2013.01) |
| ***F41B 11/684*** | (2013.01) |
| *F41A 11/04* | (2006.01) |

(52) U.S. Cl.

CPC ..... *F41B 11/684* (2013.01); *F41A 11/04* (2013.01)

(58) Field of Classification Search

None

See application file for complete search history.

(56) References Cited

U.S. PATENT DOCUMENTS

| | | | | |
|---|---|---|---|---|
| 1,373,451 | A * | 4/1921 | Roe | F41B 11/648 124/67 |
| 2,450,029 | A * | 9/1948 | Wells | F41B 11/51 124/44.7 |
| 2017/0089664 | A1* | 3/2017 | Kras | F41B 11/648 |
| 2018/0031349 | A1* | 2/2018 | Malheiros | F41B 11/648 |
| 2018/0252492 | A1* | 9/2018 | Spreadbury, III | F41B 11/648 |

FOREIGN PATENT DOCUMENTS

| | | | | |
|---|---|---|---|---|
| GB | 416560 | A * | 9/1934 | F41B 11/648 |
| GB | 943378 | A * | 12/1963 | F41B 11/647 |
| SU | 646192 | A1 * | 2/1979 | F41B 11/684 |

OTHER PUBLICATIONS

"Weihrauch HW90", T.W. Chambers Gunmakers, retrieved online on Aug. 3, 2018 from URL: https://www.gunspares.co.uk/printcatimage.asp?id=24574, 2 pages.

(Continued)

*Primary Examiner* — Gabriel J. Klein

(74) *Attorney, Agent, or Firm* — Finch & Maloney PLLC

(57) ABSTRACT

Techniques and componentry are disclosed for an air gun with a cocking linkage shoe. The air gun includes a barrel pivotally attached to a cylinder. Attached to the barrel is a linkage. The linkage is operatively coupled to a piston within the cylinder and includes a lever and a shoe. The lever has a first end attached to the barrel and a second end that includes a first surface having a concave or convex shape. The shoe is attached to the lever and operatively connected to the piston. The shoe includes a second surface having a concave or convex shape in tangential contact with the first surface of the lever. The air gun further includes a trigger mechanism configured to release the piston in response to operating the trigger mechanism.

23 Claims, 41 Drawing Sheets

(56) References Cited

OTHER PUBLICATIONS

"Ball Bearing", Wikipedia, retrieved online Mar. 23, 2017 from https://en.wikipedia.org/wiki/Ball_bearing#Angular_contact, 10 pages.
"Angular Contact Ball Bearing", SKF, retrieved online Mar. 23, 2017 from http://www.skf.com/us/products/bearings-units-housing/ball-bearings/angular-contact-ball-bearings/index.htm, 4 pages.

* cited by examiner

AIR GUN WITH COCKING LINKAGE SHOE

RELATED APPLICATIONS

This application claims priority under 35 U.S.C. § 119(e) to U.S. Provisional Patent Application No. 62/512,455 titled AIR GUN WITH COCKING LINKAGE SHOE, and filed on May 30, 2017, the contents of which are incorporated herein by reference in its entirety.

FIELD OF THE DISCLOSURE

This disclosure relates to air guns, and more particularly to air guns with a cocking linkage shoe.

BACKGROUND

Air guns are small arms, such as air pistols or rifles, that are commonly used for hunting, recreational shooting (known as plinking), and competitive shooting, such as field target events. Unlike conventional firearms that fire projectiles using chemical or explosive reactions, air guns utilize mechanically pressurized air or gas to propel projectiles (e.g., pellets or small balls called "BBs"). For instance, air guns, such as spring-piston air guns, use a mechanical means (e.g., a spring and piston) to compress air within a cylinder. The compressed air causes the projectile to be launched or otherwise propelled from the barrel of the air gun. Other air gun designs, such as compressed-gas or pneumatic air guns, utilize prefilled removable gas cylinders or an internal reservoir containing air pressurized by an on-board pump. In such instances, the internally stored pressurized air or gas (e.g., $CO_2$) is the source of energy to propel the projectile.

SUMMARY

One example embodiment of the present disclosure provides an air gun including a barrel pivotally attached to a cylinder; a linkage attached to the barrel and operatively coupled to a piston within the cylinder, the linkage including a lever having a first end and a second end, the first end of the lever attached to the barrel and the second end including a first surface having a concave or convex shape, and a shoe operatively connected to the piston and attached to the lever, the shoe including a second surface having a concave or convex shape to receive the first surface of the second end of the lever; and a trigger mechanism configured to release the piston in response to operating the trigger mechanism. In some instances, the first surface of the lever slides along the second surface of the shoe as the lever is rotated. In other instances, the first surface of the lever has a first radius that is equal to or larger than a second radius of the second surface of the shoe. In yet some other instances, at least one of the first surface of the lever and the second surface of the shoe includes a rolling element bearing. In other instances, the lever and the shoe are not supported by a stock attached to the cylinder. For example, the lever and the shoe are independent of a stock attached to the cylinder. In some other instances, the lever has a length of greater than 200 millimeters. In yet other instances, the lever is positioned at an angle of less than 25 degrees relative to a centerline of the cylinder during the entire stroke of the lever. In some instances, the air gun includes a pin connecting the lever and the shoe such that the pin is not in contact with the first surface of the lever. In some such instances, the pin supports the second end of the lever and prevents the lever from separating from the shoe. In some other instances, the shoe includes a flat surface that is received within a keyway of the piston.

Another example embodiment of the present disclosure provides an air gun including a barrel pivotally attached to a cylinder; a linkage attached to the barrel and operatively coupled to a piston within the cylinder, the linkage including a lever with a first end and a second end, the first end of the lever attached to the barrel, and a shoe disposed within the cylinder and attached to the second end of the lever, the shoe includes a curved surface in contact with a portion of an outer surface of the piston such that the piston can be rotated along the curved surface of the shoe; and a trigger mechanism disposed on the cylinder and configured to release the piston in response to operating the trigger mechanism. In some cases, the lever and the shoe are not guided by a stock attached to the cylinder. For example, the shoe travels along the piston guided by a slot in the cylinder. In other cases, the outer surface of the piston is a uniform cylindrical surface. In yet other cases, the shoe moves along the outer surface to position the piston within the cylinder. In some other cases, the shoe slides to a forward position in the cylinder upon closing the barrel. In yet other cases, the shoe includes a pair of bearing surfaces, each bearing surface is located along a bottom surface of the shoe and in contact with an inner surface of the cylinder. In some such cases, when the shoe moves through a slot within the cylinder, the pair of bearing surfaces interfaces with the inner surface of the cylinder on both sides of the slot. In some other such cases, a portion of the slot includes an opening wider than an operational portion of the slot, the opening configured to receive the shoe so as to position the shoe within the cylinder. In other such cases, the slot includes one or more inside edges with a gap disposed therebetween. In some other such cases, shoe includes at least one of a pair of grooved features and flat features to prevent contact between the shoe and the one or more inside edges of the slot. In some other cases, the air gun includes a bearing sleeve disposed on the piston, the bearing sleeve in contact with an inner surface of the cylinder. In some such cases, the bearing sleeve includes a split and a plurality of bearing surfaces, the plurality of bearing surfaces in contact with the inner surface of the cylinder. In other such cases, the bearing sleeve includes a split and a bearing surface, the bearing surface being a continuous surface disposed along an outer surface of the bearing sleeve and in contact with the inner surface of the cylinder.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1:
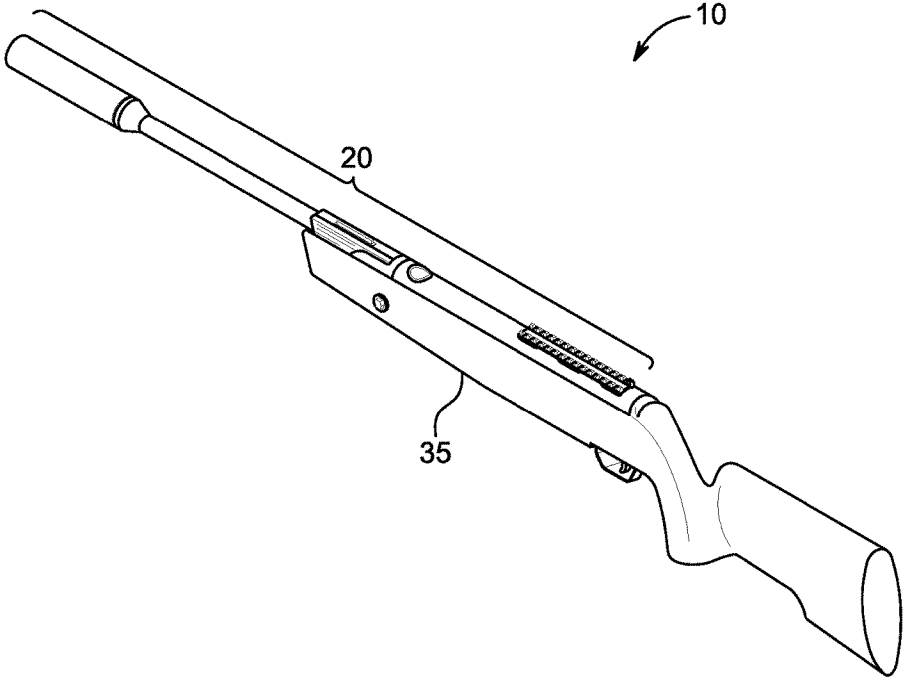
FIG. 1 is a perspective view of an air gun configured in accordance with an embodiment of the present disclosure.

These and other features of the present embodiments will be understood better by reading the following detailed description, taken together with the figures herein described. The accompanying drawings are not intended to be drawn to scale. For purposes of clarity, not every component may be labeled in every drawing.

DETAILED DESCRIPTION

In one aspect, an air gun with a cocking linkage shoe is disclosed. For example, the air gun is a break-barrel air rifle with a barrel pivotally attached to a compression cylinder. Attached to the barrel is a cocking linkage that is operatively coupled to a piston within the compression cylinder. The cocking linkage includes a lever and a shoe. The lever has a first end attached to the barrel and a second end that includes a concave surface to receive a convex surface of the shoe. The shoe is attached to the lever and is operatively connected to the piston. As the barrel is rotated downward, the lever moves the shoe within the compression cylinder, which in turn causes the shoe to move the air piston to engage a trigger mechanism. The convex surface of the shoe is in tangential contact with the concave surface of the lever to allow the surfaces to slide or otherwise rotate relative to one another as the lever is rotated. Tangential contact is when the points of contact between the concave surface of the lever and the convex surface of the shoe are in a radial plane along which a load is applied (e.g., a force applied by the lever to the shoe). With the air piston held by the trigger mechanism, the shoe can move forward within the compression cylinder by rotating the barrel to a closed, ready to fire, position (e.g., aligned with the compression cylinder). At the completion of the cocking action, a trigger mechanism can be operated by a user to release the air piston to fire the air gun.

General Overview

Break barrel guns are typically operated using a mechanical linkage to cock or otherwise ready the gun for use. These mechanical linkages, however, can often be difficult to operate. For instance, some mechanical linkages include a lever with a flat end in contact with a piston of a piston assembly. As the lever rotates, the flat end rotates against the piston causing an increase in contact stress. The contact stress increases because only a portion of the flat end of the lever contacts the piston as the lever is rotated. In other words, the force from the lever is transmitted to the piston through a smaller contact area, causing the linkage to be more difficult to operate. To avoid increases in contact stress, other air gun configurations include a mechanical linkage with a primary and a secondary lever. The primary lever can be attached to the barrel at one end and to the secondary lever at the other end. The secondary lever is guided within a stock and its opposing end is configured to engage the piston. During operation, the primary lever is rotated downward while the secondary lever is moved linearly in a backward direction away from the muzzle end of the barrel. As a result, the angle between the two levers increases as the cocking procedure progresses. Thus, less of the force transmitted by the primary lever can be used to slide the piston, because a smaller component of that force is aligned with the piston that extends horizontally within the compression cylinder. Rather, a larger component of the force is directed normal to the compression cylinder (e.g., in a vertical direction), and thus increases friction between the secondary link and compression cylinder rather than contributing to the compression of the piston. As a result, the cocking linkage mechanism is less efficient in transferring the energy to compress the piston, and thus the air gun is more difficult to operate.

Thus, and in accordance with an embodiment of the present disclosure, an air gun is disclosed, such as a break-barrel air rifle with a cocking linkage shoe. The air gun includes a barrel pivotally attached to a compression cylinder. Attached to the barrel is a cocking linkage that is operatively coupled or otherwise connected to an air piston assembly within the compression cylinder. The cocking linkage includes a lever and a shoe. The lever has a first end pivotally attached to the barrel and a second end that includes a semi-cylindrical surface to receive a complementary semi-cylindrical surface of the shoe. The lever transmits an applied force from the barrel to the shoe to re-position the air piston assembly within the compression cylinder. In an example embodiment, the lever has a unitary body with a length greater than 200 millimeters (mm). During the entire cocking action, the lever can be positioned at a dynamic angle of less than 30 degrees, less than 20 degrees or less than 15 degrees relative to a centerline of the compression cylinder.

Attached to the lever is the shoe that is also operatively connected to the air piston assembly. In an example embodiment, the shoe is retained within the compression cylinder such that it moves along an inner surface of the compression cylinder and along an outer surface of the piston of the air piston assembly. The shoe includes a semi-cylindrical surface to receive the semi-cylindrical surface of the lever. For example, the shoe can include a convex surface that is sized to receive a concave surface on the lever. These surfaces are in tangential contact with one another, and thus rotate relative to one another as the lever is rotated. Note, when connected by a pin (e.g., a coil pin), the shoe supports one end of the lever during its movement while the pin prevents the components from becoming separated from one another. The pin, in some embodiments, may be the center of rotation of the movement between the radial surfaces of the shoe and the lever. In addition, the lever and shoe can move independently of a stock attached to the air gun.

In some embodiments, the shoe can include a curved surface that contacts the outer cylindrical surface of the piston. The curved surface allows the shoe to travel along the outer surface of the piston during the cocking action. For instance, the shoe, in some embodiments, is configured to move along the outer surface of the air piston to re-position the air piston to engage the trigger mechanism. With the air piston held in compression by the trigger mechanism, the shoe can move forward within the compression cylinder by rotating the barrel to a closed position (e.g., the barrel axially aligned with the compression cylinder). When in a forward position, the shoe provides clearance for releasing the air piston assembly during the firing cycle.

The air gun further includes an air piston assembly that, when released by the trigger mechanism, compresses air within the cylinder to launch the projectile from the barrel. The air piston assembly includes a seal in contact with an inner surface of the compression cylinder to allow the piston to compress and move air during the firing cycle. In some embodiments, the air piston assembly can include one or more bearing sleeves, which position the piston relative to the compression cylinder and prevent contact therebetween. The bearing sleeve can also be manufactured from a material with a low coefficient of friction, and thus make the air gun easier to operate. The low-friction material of the bearing sleeve can reduce friction between the piston assembly and the inner surface of the compression cylinder.

The air piston assembly is contained within the compression cylinder. The compression cylinder not only houses the air piston assembly, but also guides the operation of the shoe. In an example embodiment, the compression cylinder includes an opening through which the shoe can pass so that an upper portion of the shoe can be positioned between the air piston assembly and a wall of the compression cylinder, as previously described. A slot is located adjacent to the opening and communicates with the opening. The slot guides the shoe as it moves along an inner surface of the compression cylinder to re-position the air piston assembly to ready the air gun for use.

As discussed herein, terms referencing direction, such as upward, downward, vertical, horizontal, left, right, front, back, etc., are used for convenience to describe embodiments of an air rifle oriented according to customary use when firing a projectile in a horizontal direction. Embodiments of the present disclosure are not limited by these directional references and it is contemplated that an air gun and cocking linkage in accordance with the present disclosure could be used in any orientation.

Example Air Gun Application

FIG. 1 is a perspective view of an air gun 10 configured in accordance with an embodiment of the present disclosure.

In a general sense, an air gun is a small arm (e.g., a pistol or rifle) that that propels projectiles by means of pressurized air or other gas. Air guns typically propel plastic or metallic projectiles, for example, non-spherical hollow pellets, or spherical balls, called BBs. The air gun may be configured in a variety of calibers including, but not limited to .177 (4.5 mm) and .22 (5.5 mm & 5.6 mm) calibers. In an example embodiment, air gun 10 includes an action assembly 20 and a stock 35. The action assembly 20 enables a user to load the air gun 10 and make it ready for firing. Attached to the action assembly 20 is a stock 35. Stock 35 is the portion of air gun 10 that is held by a person when firing or otherwise handling the gun.

Figure 2:
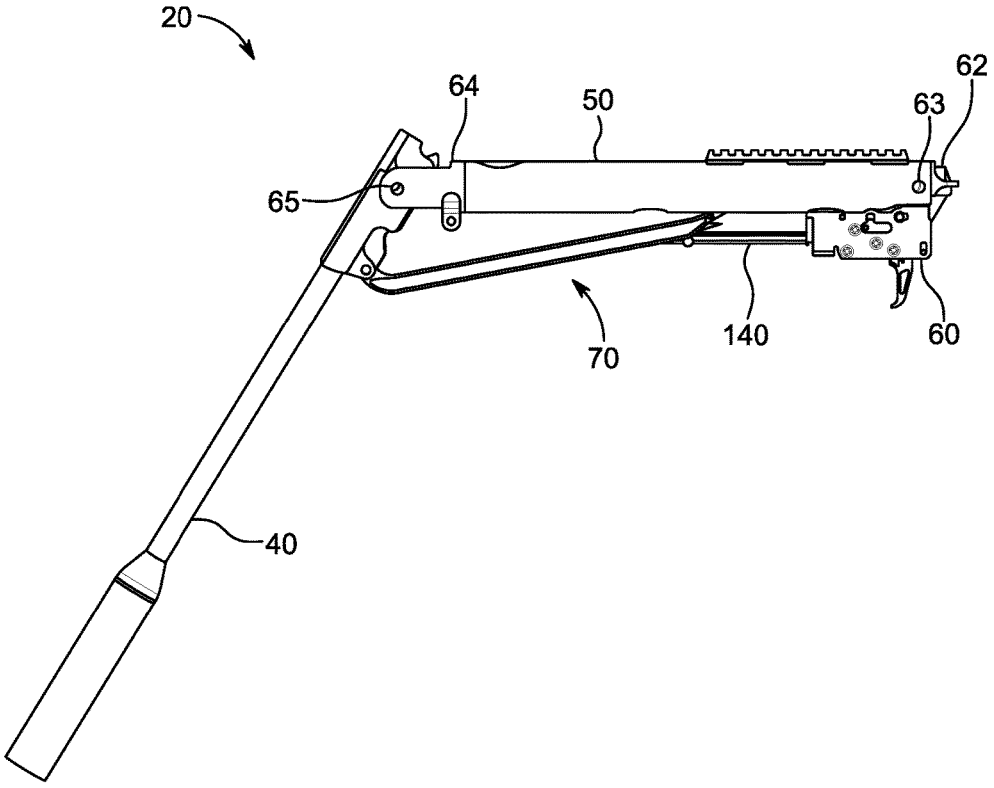
FIG. 2 is a side view of an action assembly of the air gun shown in FIG. 1, in accordance with an embodiment of the present disclosure.

FIG. 2 is a side view of an action assembly 20 of the air gun 10 shown in FIG. 1 with a compression cylinder 50 oriented horizontally, in accordance with an embodiment of the present disclosure. The action assembly 20, as previously mentioned, allows a user to load and make the air gun ready for firing. In an example embodiment, the action assembly 20 includes a barrel 40, a compression cylinder 50, a trigger mechanism 60, a piston plug 62 attached to the compression cylinder 50 using pin 63, and a cocking linkage assembly 70. The barrel 40 is configured to receive a projectile during loading of the firearm. In the example embodiment, the barrel 40 is pivotally connected to a compression fork 64 disposed on one end of the compression cylinder 50 using pin 65, such that once loaded, the barrel 40 can be positioned in alignment with the compression cylinder 50, which in turn readies the air gun 10 for use.

Attached to the barrel 40 is a compression cylinder 50 that is separate from the barrel 40. The compression cylinder 50 can include a spring-loaded piston assembly that provides a source of air or gas pressure to propel the projectile through the barrel 40. Disposed at one end of the compression cylinder 50 (the end opposite where the barrel 40 is attached) is a piston plug 62. The piston plug 62 is secured to the compression cylinder 50 using a pin 63, so that the piston plug 62 remains fixed relative to the compression cylinder 50. Piston plug 62 is constructed to receive the end of the piston, such that the spring-loaded piston assembly can be placed in the ready-to-fire or cocked position. In other embodiments, the end of the piston may not directly contact the piston plug 62. This may be the case, for example, when the compression cylinder 50 has a length that is longer than the operating stroke of the piston assembly such that the piston plug 62 is positioned at a distance from the end of the piston.

The compression cylinder 50 is operatively coupled to a trigger mechanism 60 and a cocking linkage assembly 70. Trigger mechanism 60 maintains the piston assembly of the compression cylinder 50 in the cocked or ready-to-fire position once the user has operated the cocking linkage assembly 70. In addition, the trigger mechanism 60 actuates or otherwise begins the firing cycle for the air gun 10, thereby causing the projectile to be propelled through the barrel 40. The cocking linkage assembly 70 positions or otherwise resets the piston in the ready-to-fire position to enable another firing cycle of the air gun 10. In more detail, a user can cock the air gun 10 by breaking the barrel 40 and pivoting the barrel 40 downward with respect to the compression cylinder 50, which in turn operates the cocking linkage assembly 70. Operation of the cocking linkage assembly 70 in turn causes the piston within the compression cylinder 50 to move backwards and to compress a spring or other energy storage device. At the end of this operation, the trigger mechanism 60 engages the piston utilizing a sear. The sear maintains the piston in a cocked or ready to fire position. With the barrel pivoted downward, the breech end of the barrel 40 is exposed and can be loaded with a projectile. Once loaded, the barrel 40 can be pivoted back up to a closed position, completing the cocking action. A trigger blade of the trigger mechanism 60 can then be manipulated (e.g., pulled) to disengage the sear from the piston, to allow the piston to move forward within the compression cylinder 50. This piston movement compresses air in front of the piston causing the air to move through an outlet within the compression cylinder 50 (e.g., located in front of the piston and directly behind a projectile positioned in the barrel 40). The compressed air applies a force on the projectile that overcomes the static frictional forces between the projectile and the barrel 40, and thus causing the projectile to be propelled forward through the barrel 40.

Example Cocking Linkage Assembly

Figure 3:
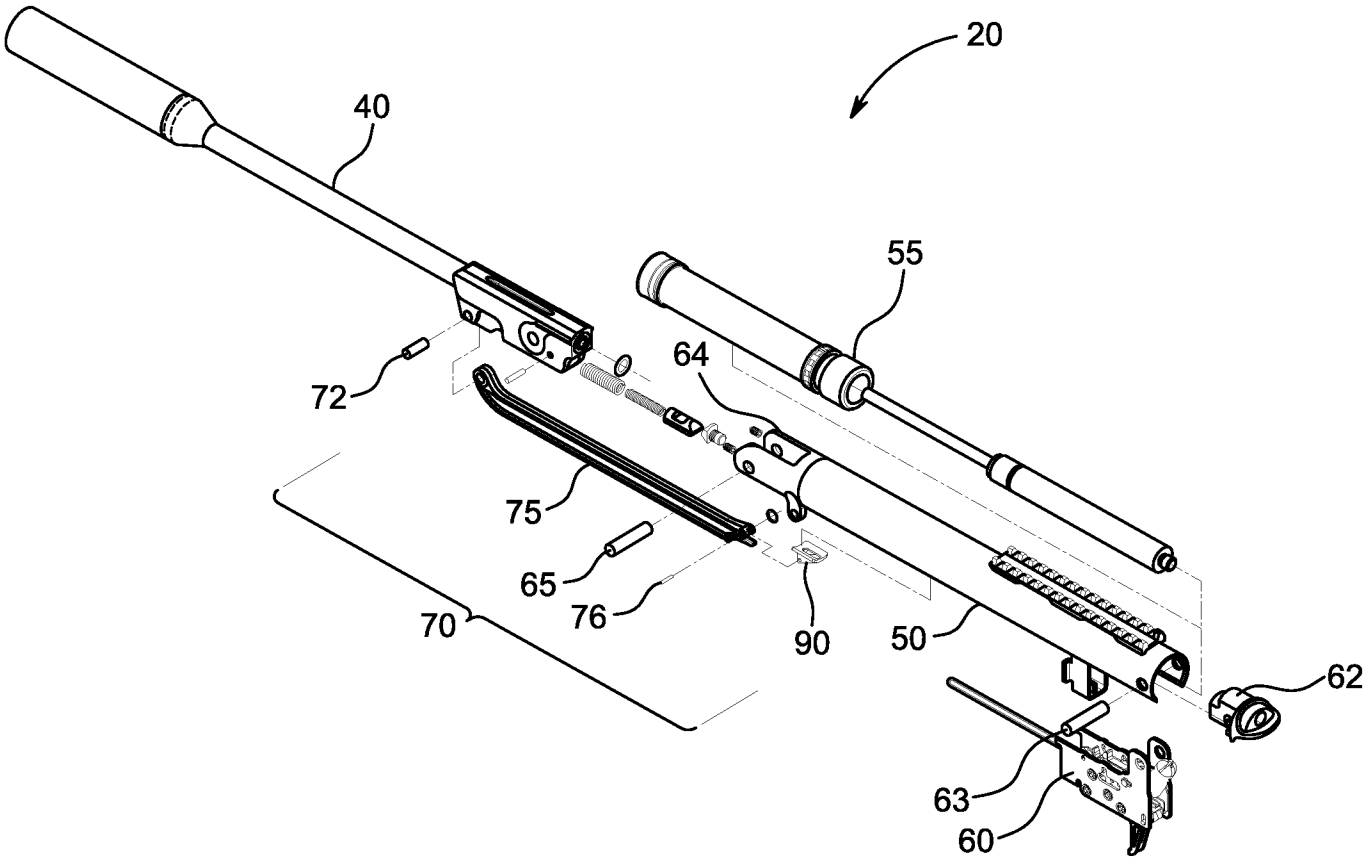
FIG. 3 is an exploded view of an action assembly shown in FIG. 2, in accordance with an embodiment of the present disclosure.

FIG. 3 is an exploded view of the action assembly 20 shown in FIG. 2, in accordance with an embodiment of the present disclosure. As can be seen, the barrel 40 is attached to a cocking linkage assembly 70. The cocking linkage assembly 70 is constructed and arranged to move the air piston assembly 55 within the compression cylinder 50, as previously described herein. In an example embodiment, the cocking linkage assembly 70 includes a lever 75 attached to the barrel 40 using pin 72 at one end. The other end of the lever 75 is attached to the shoe 90. A portion of the shoe 90 is disposed within the walls of the compression cylinder 50 which, when assembled, encases the air piston assembly 55. Shoe 90 can contact or otherwise movably interface with one or more surfaces of the piston of the air piston assembly 55 to allow the shoe 90 to move thereon.

Figure 4:
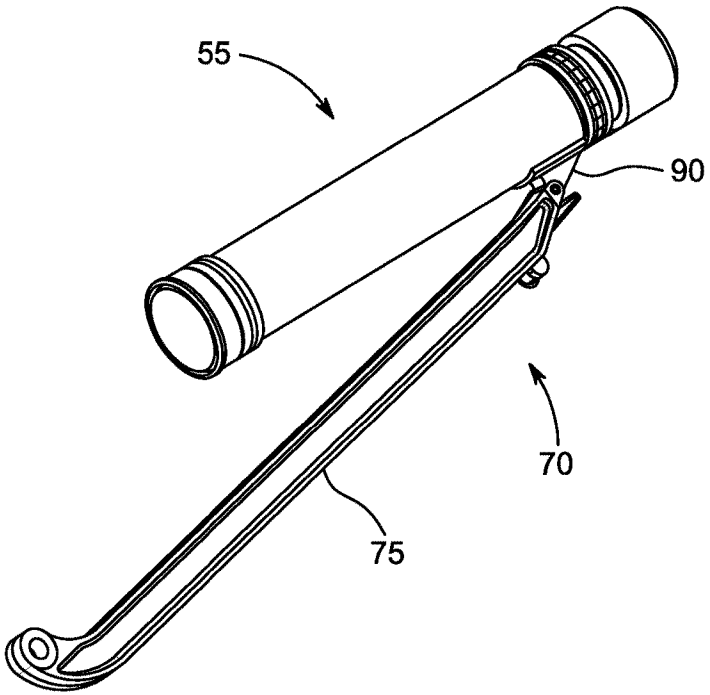
FIG. 4 is a perspective view of the cocking linkage assembly and air piston assembly shown in FIGS. 2 and 3, in accordance with an embodiment of the present disclosure.
Figure 5:
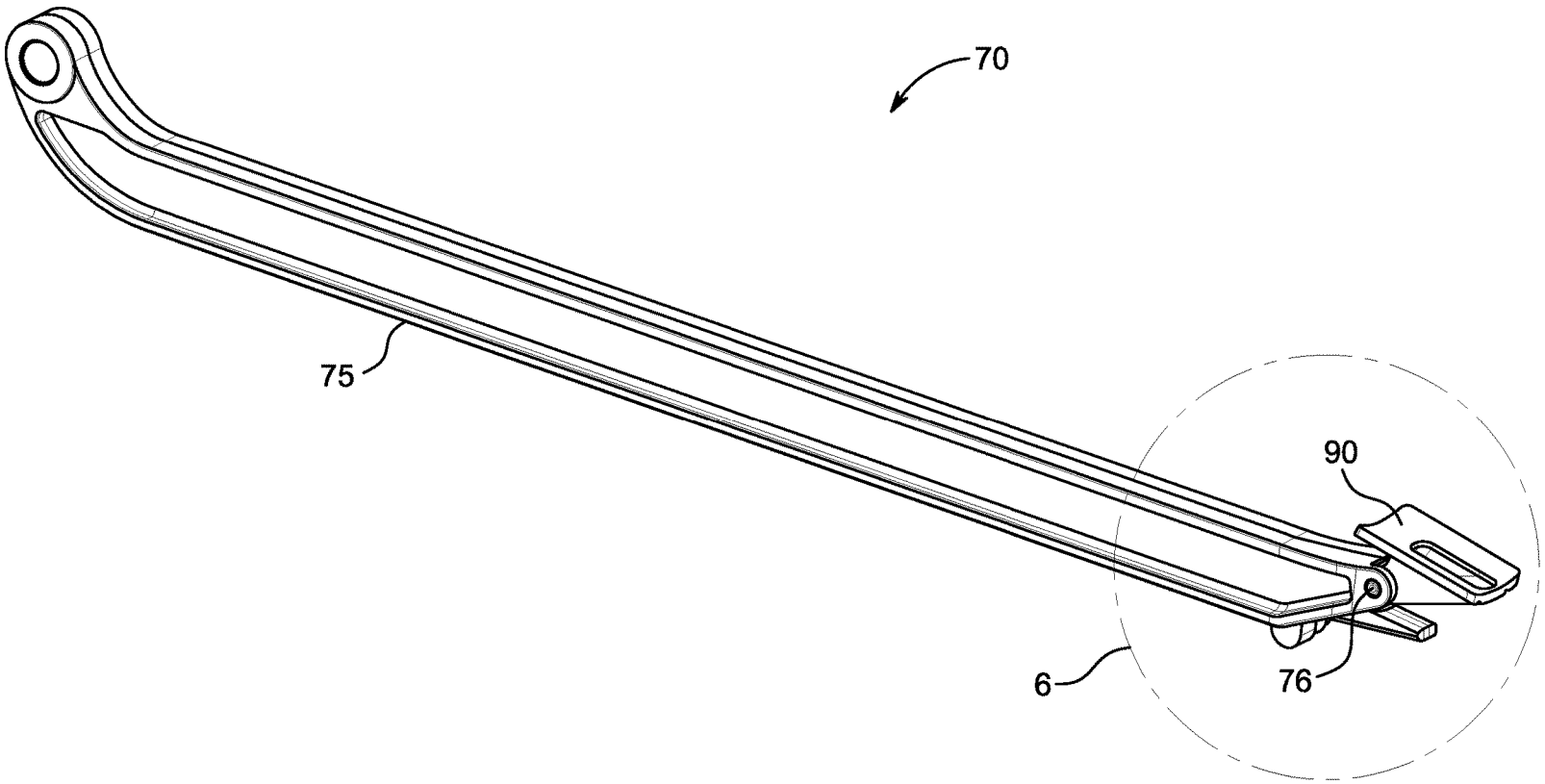
FIG. 5 is a perspective view of the cocking linkage assembly shown in FIG. 4, in accordance with an embodiment of the present disclosure.
Figure 6:
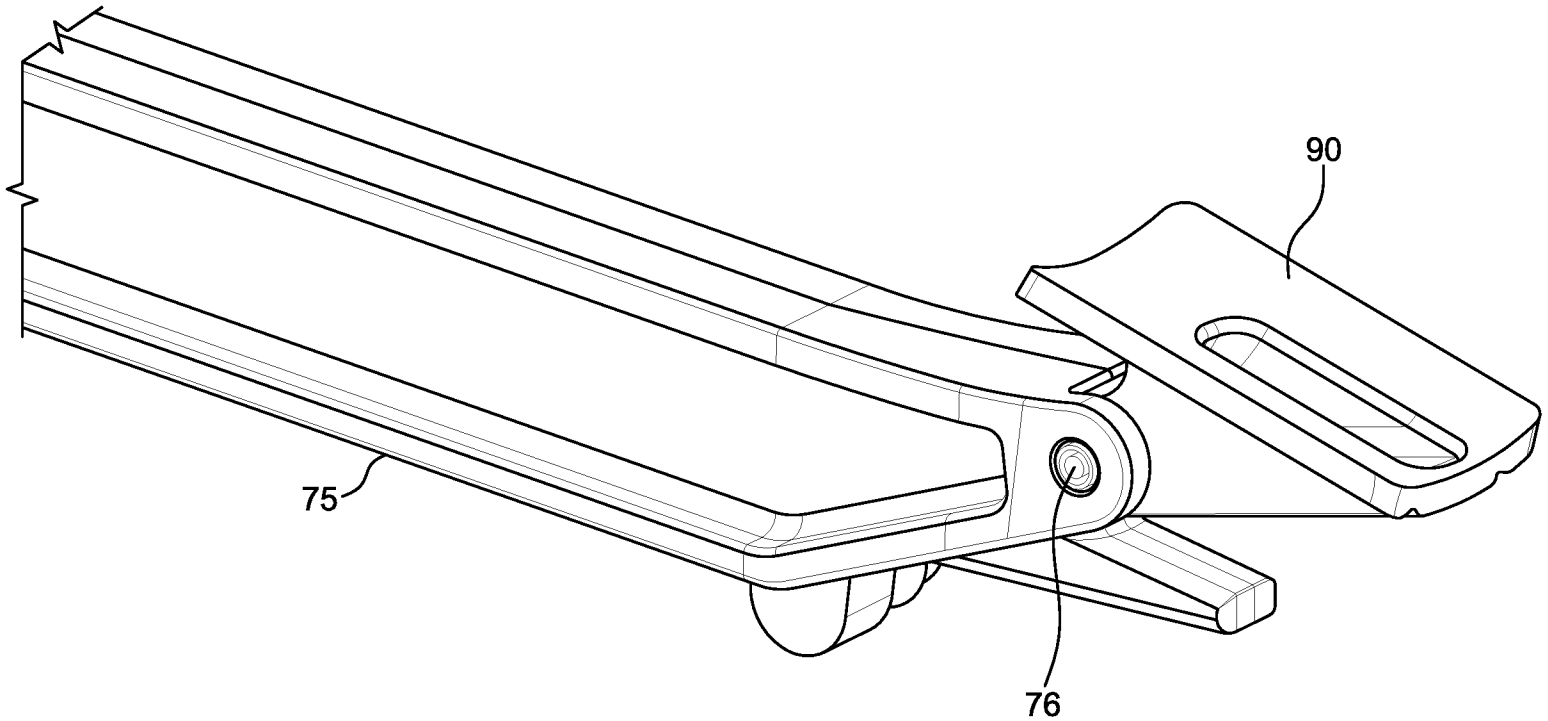
FIG. 6 is an enlarged view of a portion of the cocking linkage assembly shown in FIG. 5, in accordance with an embodiment of the present disclosure.

FIG. 4 is a perspective view of the cocking linkage assembly 70 and air piston assembly 55, in accordance with an embodiment of the present disclosure. FIG. 5 is a perspective view of the cocking linkage assembly 70 shown in FIG. 4. FIG. 6 is an enlarged view of a portion of the cocking linkage assembly 70 shown in FIG. 5. In an example embodiment, the cocking linkage assembly 70 includes a lever 75 and a shoe 90 attached thereto with a pin 76. The lever 75 transmits the force applied by the user at the barrel during the cocking action to the shoe 90. The shoe 90, in turn, moves within the compression cylinder 50 to position the air piston assembly 55 to a ready-to-fire position. The pin 76 (e.g., a coil pin) ensures that the lever 75 and shoe 90 remain coupled together and do not become separated from one another as the lever 75 is rotated upward. During that motion, the pin 76 also enables the lever 75 to rotate about the shoe 90 by loosely coupling the lever 75 to the shoe 90. Unlike when the lever 75 is rotated downward, an upward rotation of the lever 75 causes the concave and convex surfaces of the lever 75 and shoe 90 (respectively) to separate or otherwise be pulled apart or away from one another. Thus, during such movement there may be insufficient contact between the lever 75 and shoe 90 to keep them coupled together. In addition, the pin 76 can support one end of the lever 75 so that the lever 75 and shoe 90 can move independently without guidance or support from the stock 35 attached to the air gun 10.

Figure 7:
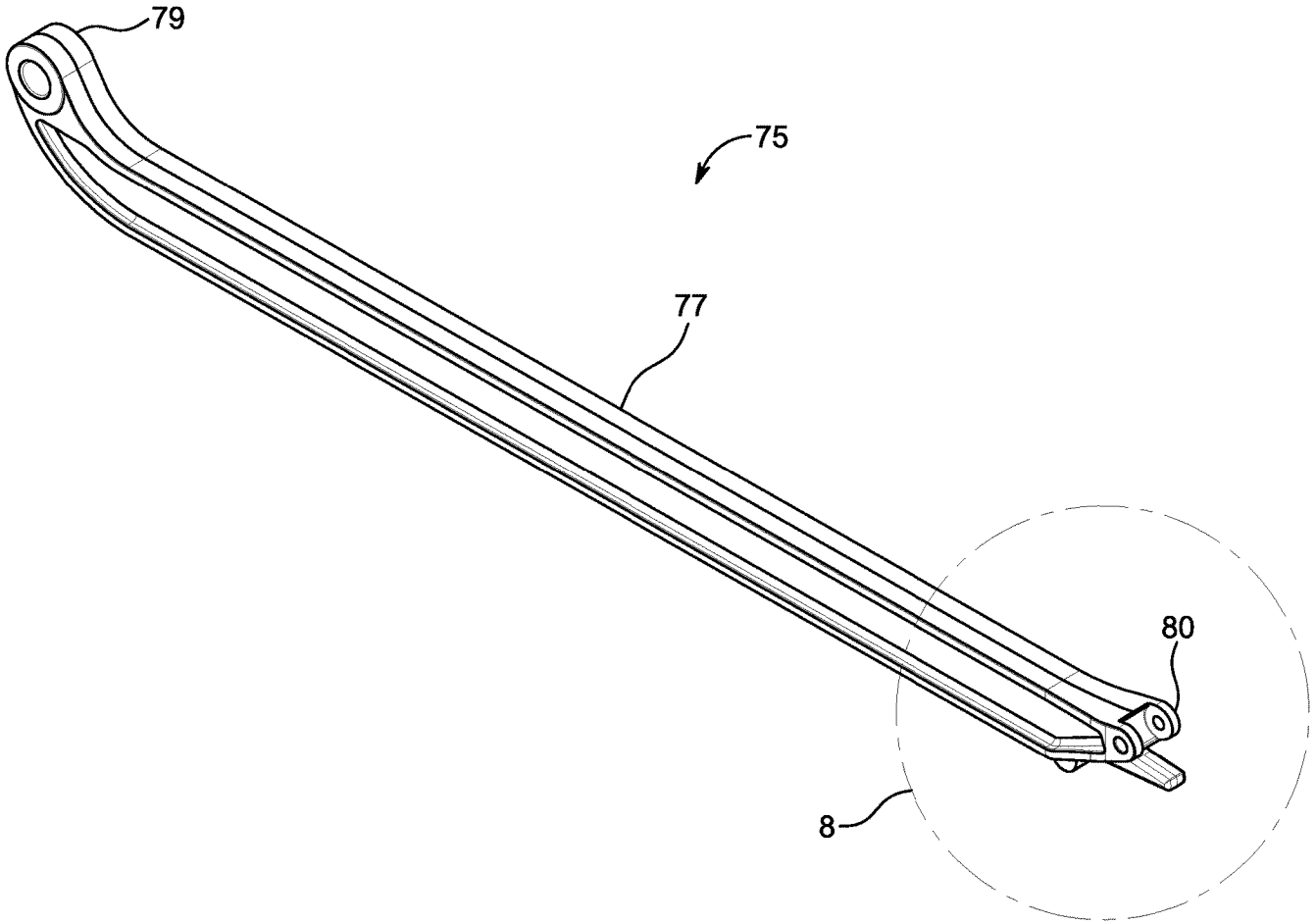
FIG. 7 is a perspective view of a lever of the cocking linkage assembly shown in FIG. 5, in accordance with an embodiment of the present disclosure.

FIG. 7 is a perspective view of a lever 75 for the cocking linkage assembly 70 of FIG. 5, in accordance with an embodiment of the present disclosure. In a general sense, the lever 75 of the cocking linkage assembly 70 transmits a substantial portion of the force applied by a user at the barrel 40 to the air piston assembly 55 via the shoe 90. As a result, the air piston assembly 55 moves within the compression cylinder 50. For example, the lever 75 can be pivoted about the center of the semi-cylindrical surface on the shoe 90 by approximately 11.5 degrees when moving the lever from a position parallel to the compression cylinder 50 (e.g., a firing position) to a position that loads the air piston assembly 55 within the compression cylinder 50 (e.g., a cocked position). between the firing position and the cocked position. In other cases, the lever 75 can be rotated from 0 degrees to 20 degrees, including from 5 to 15 degrees, from 10 to 15 degrees, from 10 to 13 degrees, or from 11 to 12 degrees between the firing position and the cocked position. In some embodiments, this range may be greater than 20 degrees, for instance, when the pin 72 is located further below a centerline of the air gun 10. Note that while lever 75 may rotate less than 25 degrees, the barrel 40 can be rotated greater than 90 degrees in order to provide the mechanical advantage necessary to load the piston.

The lever 75 can be made from a number of materials, including carbon steel, stainless steel, aluminum, and zinc. In an example embodiment, the lever 75 is manufactured from a zinc-alloy using a die-cast process. In some embodiments, the lever 75 can include a protective finish, such as electrocoat finish. As can be seen, the lever 75 includes a body 77 with a first end 79 and a second end 80. The body 77, in an example embodiment, can be substantially straight, but this need not be the case in all instances. Furthermore, the body 77 can be tapered, such that one end 79 or 80 (or both) is wider than the body 77 to reduce an overall weight of the lever 75. Body 77, in some embodiments, can be reduced (e.g., with one or more radius machined features) to further reduce the overall weight of the lever 75. In addition, the ends 79 and 80 need not be positioned in line with one another or along a centerline of the body 77 (e.g., one end may be higher than another and both ends may be above a centerline of the body 77). In an example embodiment, the first end 79 and second end 80 are offset from one another from 5 to 10 mm, such as approximately 8 mm, relative to the centerline. The body 77 can be any length sufficient to re-position the air piston assembly 55 to engage the trigger mechanism 60. In an example embodiment, the body 77 has a length of approximately 231 mm from a center of an attachment point located at each end of the lever 75. The body 77, in some other embodiments, can have a length of greater than 150 mm, 200 mm, 210 mm, 250 mm, 300 mm or 400 mm. In the same and other embodiments, body 77 can have a length of less than 500 mm, less than 450 mm, less than 350 mm or less than 250 mm.

The lever 75 includes a first end 79 to be pivotally attached to the barrel 40 of the air gun 10. In some embodiments, the first end 79 can be attached to the barrel 40 using a pin (e.g., pin 72). As the barrel 40 is rotated downward by a user, the first end 79 transmits the force from the barrel 40 to the body 77 of the lever 75. In an example embodiment, the first end 79 includes a through hole to receive pin 72. The first end 79 can be curved upwardly, such that the center of the through hole is located approximately 7 mm above a top surface of the body 77. In other embodiments, the first end 79 can have a width that is less than the width of the second end 80. Numerous other configurations will be apparent in light of the present disclosure.

Figure 8:
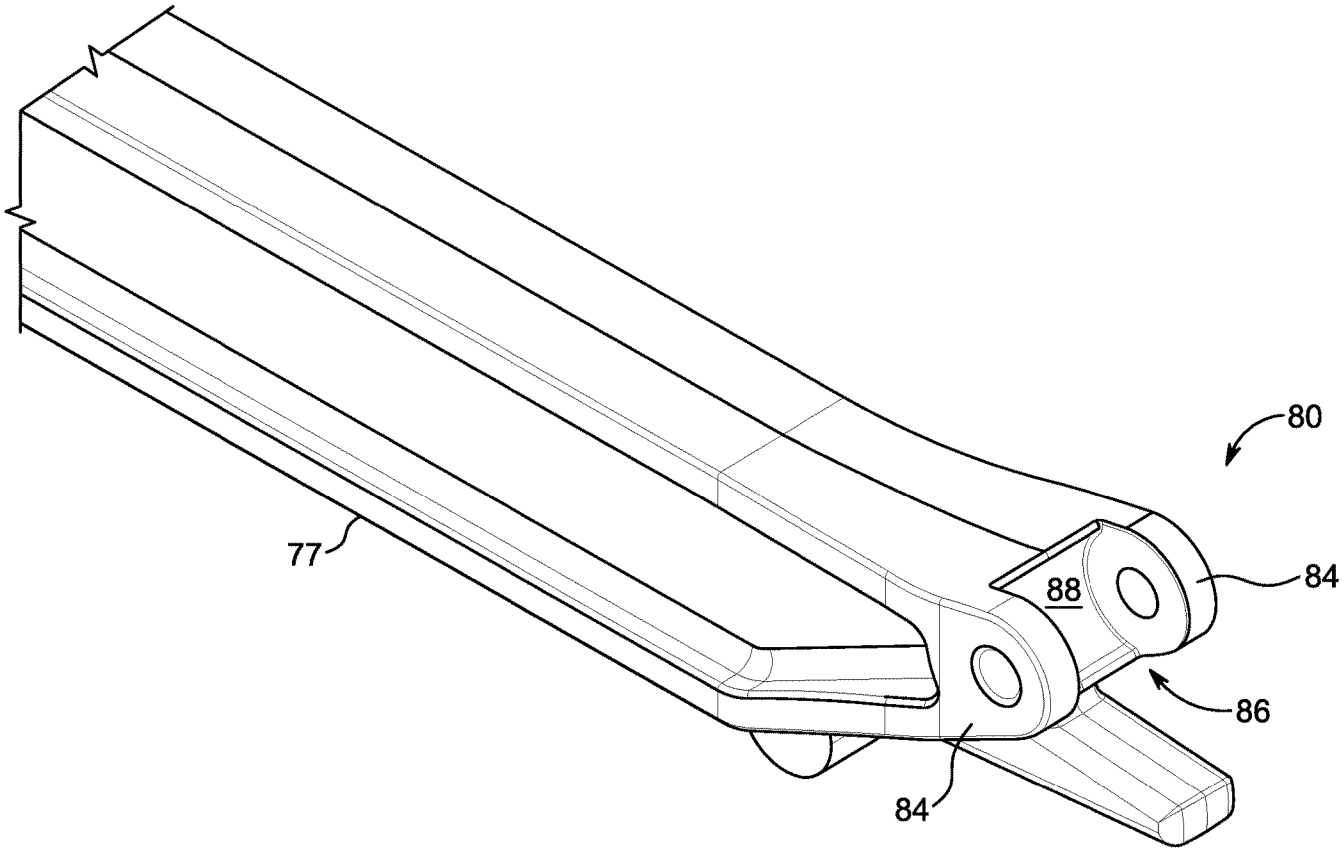
FIG. 8 is an enlarged view of one end of the lever shown in FIG. 7, in accordance with an embodiment of the present disclosure.
Figure 9:
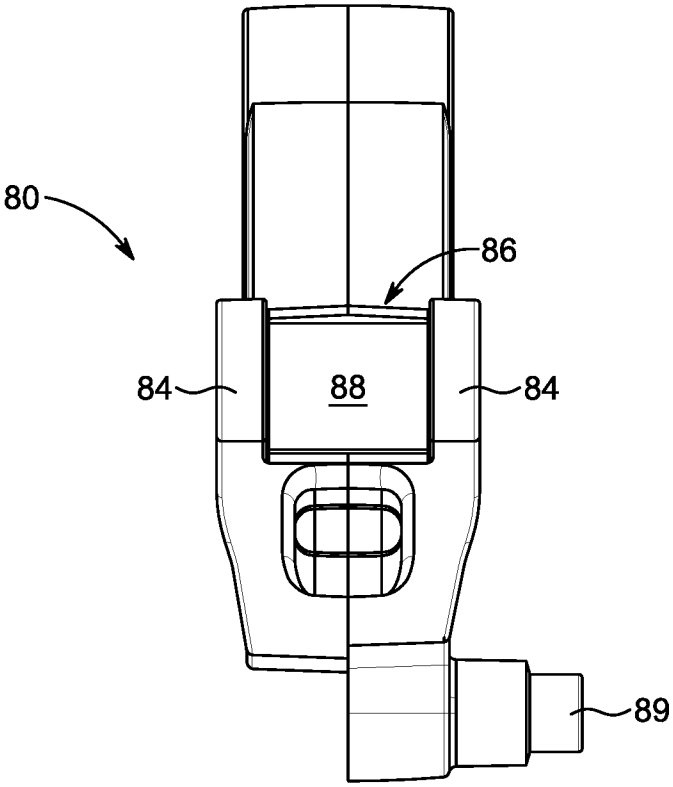
FIG. 9 is an end view of the one end of the lever shown in FIG. 7, in accordance with an embodiment of the present disclosure.

FIG. 8 is a perspective view of one end 80 of the lever 75 shown in FIG. 7, in accordance with an embodiment of the present disclosure. FIG. 9 is an end view of the end 80 of the lever 75 shown in FIG. 7. The lever 75 has a second end 80 that is disposed on the body 77 opposite the first end 79. The second end 80 is configured to rotate about the shoe 90 and transmit the force applied by the user at the barrel 40 to the shoe 90. The angle of rotation of the body 77 about the shoe 90 can be, for example, greater than 10 degrees, greater than 15 degrees, greater than 20 degrees, greater than 25 degrees, less than 45 degrees, less than 35 degrees or less than 25 degrees from a lever position parallel to the compression cylinder 50.

The second end 80 includes supports 84, a recess 86, a lever bearing surface 88, and an attachment point 89. Each support 84 is to receive a pin (e.g., 76) and together define recess 86 to receive the shoe 90 therein. When installed in the supports 84, the pin 76 prevents the lever 75 from disengaging or otherwise decoupling from the shoe 90 as it rotates. When installed, however, the pin 76 does not contact the bearing surface of the shoe 90. A lever bearing surface 88 is located between the supports 84 and within the recess 86. The lever bearing surface 88 can transmit most or all of the compression force from the lever 75 to the shoe 90, thereby reducing or otherwise eliminating the force on pin 76 and support 84.

In an example embodiment, the lever bearing surface 88 is a concave surface. The lever bearing surface 88 is constructed to receive or otherwise mate with a corresponding curved surface (e.g., a convex surface) on the shoe 90. In some other embodiments, the lever bearing surface 88 can be a convex surface that is configured to be received in a concave surface of the shoe 90. The lever bearing surface 88 can also be configured such that its cross section is a combination of angled, rounded, contoured, tapered, or flat profiles that can be received by or otherwise engage a corresponding surface of the shoe 90. When configured as a combination of surfaces, the lever bearing surface 88 can also limit or prevent movement of the lever 75 relative to the shoe 90 in an axial direction. For example, a contoured lever bearing surface 88 having a polygonal or semi-circular cross section can prevent axial movement of the lever 75 in relation to shoe 90 because the sloped or tapered geometry of those bearing surfaces does not allow one surface to move or otherwise slide across the other. In some other embodiments, the lever bearing surface 88 can be a convex or concave surface having a cross-sectional profile that includes angled, rounded, contoured, tapered, or flat profiles. As the lever 75 is rotated, the lever bearing surface 88 can slide along the corresponding surface of the shoe 90 in a manner similar to the respective surfaces of bushing-bearings or ball joint connections. Thus, the lever bearing surface 88 is in tangential contact with the corresponding curved surface of the shoe 90 to transmit the load from the lever 75 to the shoe 90. Hence, the lever bearing surface 88 is located where the force of the lever 75 is applied to the shoe 90. As a result, the lever 75 is easier to operate because the force of the lever 75 is applied across an area of the shoe 90 rather than at a single location thereon. The lever bearing surface 88 can have a surface area ranging from 10 to 80 square (sq.) mm, depending on a given application. In some embodiments, the lever bearing surface 88 can include a rolling element bearing, in which case the two adjoining radial surfaces do not slide in relation to each other. As shown in FIG. 9, for example, the second end 80 of the lever 75 can also include an attachment point 89 to receive an arm of the trigger safety mechanism 140. Numerous other lever configurations will be apparent in light of the present disclosure.

Figure 10:
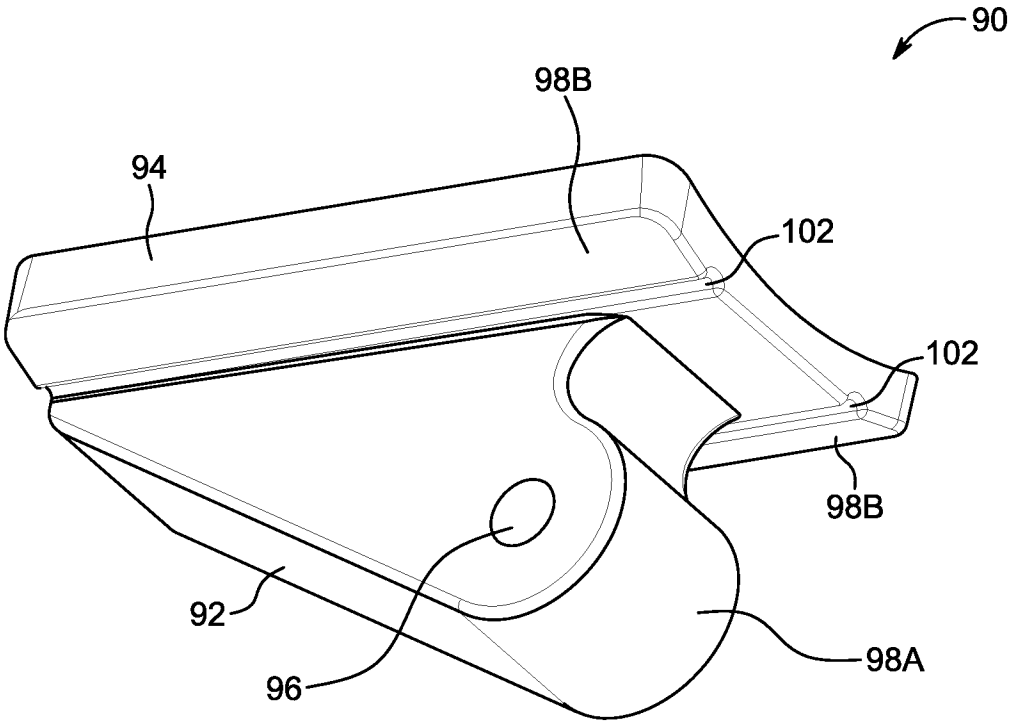
FIG. 10 is a perspective view of a shoe of the cocking linkage assembly of FIG. 5, in accordance with an embodiment of the present disclosure.
Figure 11:
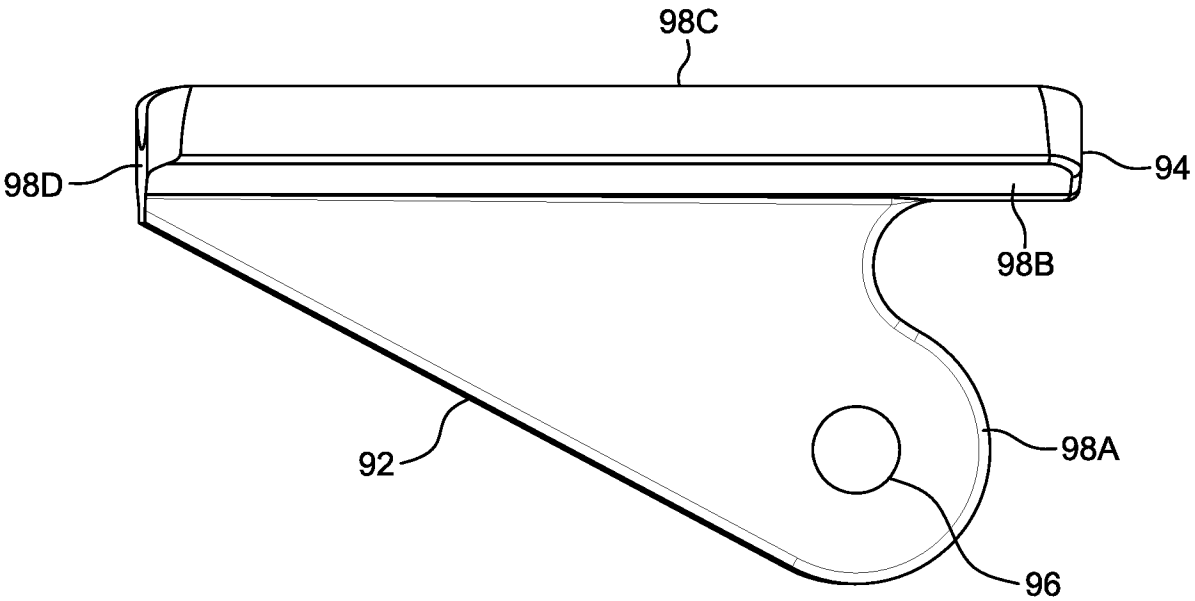
FIG. 11 is a side view of the shoe shown in FIG. 10, in accordance with an embodiment of the present disclosure.
Figure 12:
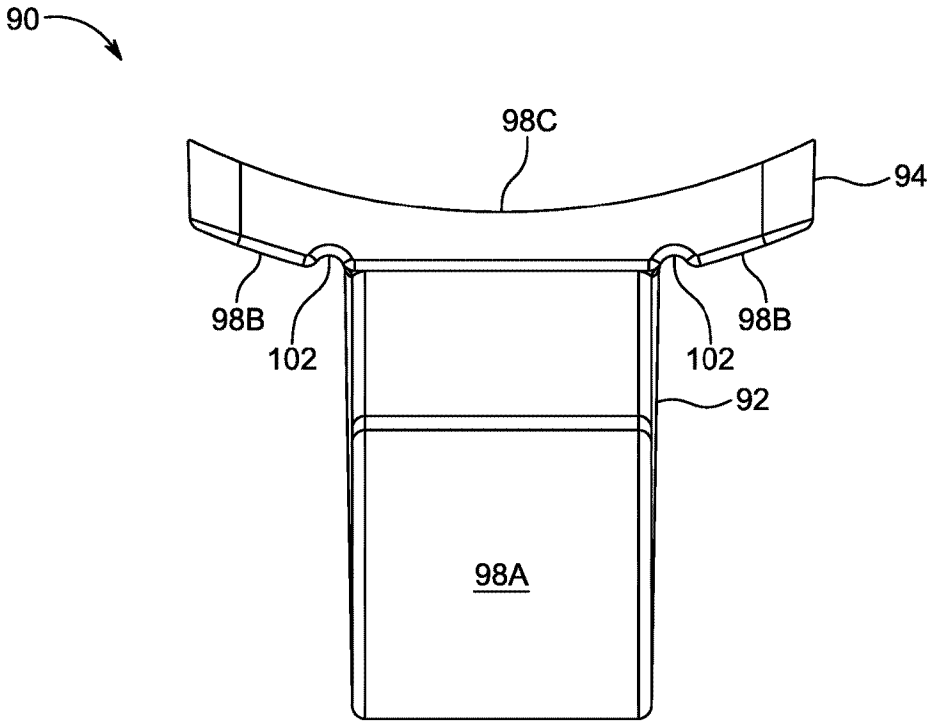
FIG. 12 is a front view of the shoe shown in FIG. 10, in accordance with an embodiment of the present disclosure.
Figure 13:
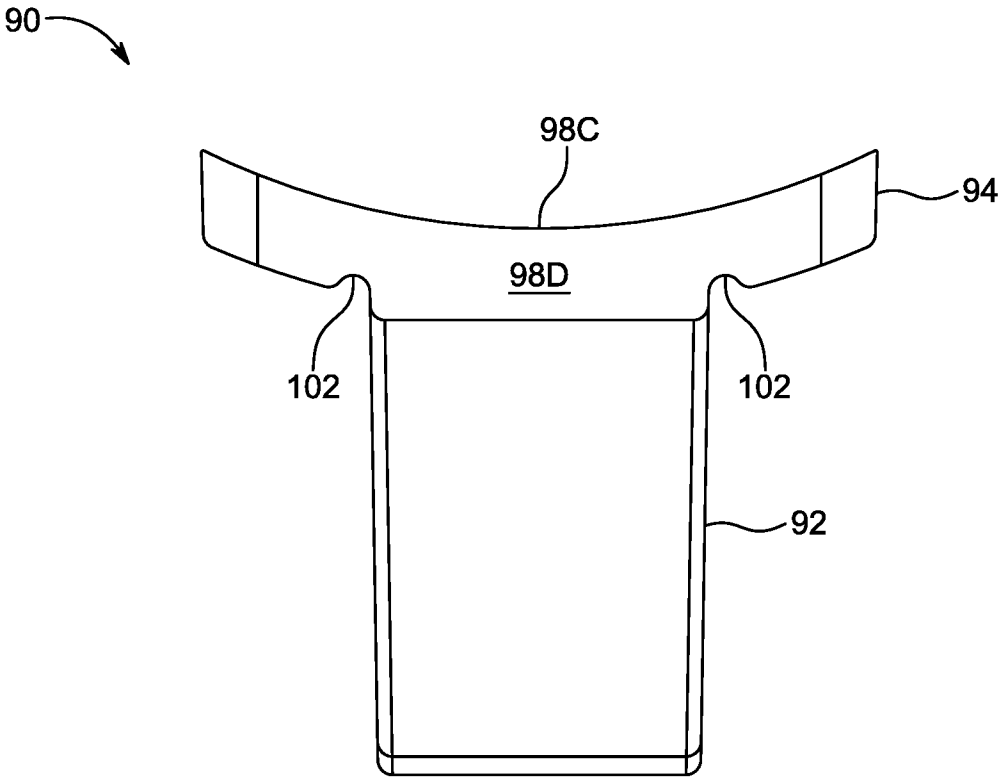
FIG. 13 is a rear view of the shoe shown in FIG. 10, in accordance with an embodiment of the present disclosure.

FIG. 10 is a perspective view of a shoe 90 for the cocking linkage assembly 70 of FIG. 5, in accordance with an embodiment of the present disclosure. FIG. 11 is a side view of the shoe 90 shown in FIG. 10. FIG. 12 is a front view of the shoe 90 shown in FIG. 10. FIG. 13 is a rear view of the shoe 90 shown in FIG. 10. A shoe 90 is rotatably attached to the lever 75. The shoe 90 moves within the compression cylinder 50 to load the air piston assembly 55. Thus, as the user pivots barrel 40 about pin 65 installed within compression fork 64, and lever 75 is rotated downward, the lever 75 transmits a force onto the shoe 90. In response, the shoe 90, transmits a portion of that force (e.g., a horizontal force component) onto the air piston assembly 55 causing it to move to a higher energy position.

In an example embodiment the shoe 90 includes a base member 92 and a top member 94 disposed thereon. Along the base member 92 and top member 94 are a shoe pivot bearing surface 98A, a shoe bottom bearing surface 98B, a shoe top bearing surface 98C, and a shoe end bearing surface 98D (collectively shoe bearing surfaces 98) that contact components of the air gun 10, such as the lever 75, air piston assembly 55, and compression cylinder 50. Some of these bearing surfaces (e.g., shoe pivot bearing surface 98A and shoe end bearing surface 98D) transmit forces from the lever 75 to move the air piston assembly 55 to a ready-to-fire position, thereby compressing a spring disposed within the compression cylinder 50. The shoe 90 can be manufactured from materials, such as carbon steel or stainless steel, that can withstand the forces applied by the lever 75 and air piston assembly 55 as the air gun 10 is positioned in the ready-to-fire position. In some embodiments, the shoe bottom bearing surface 98B can be considered an outer shoe surface since it is convex and constructed to contact the inner surface of the compression cylinder 50. Similarly, the shoe top bearing surface 98C can be considered an inner shoe surface since it is concave and configured to contact an outer surface of the piston 110.

The base member 92 attaches to the lever 75. In an example embodiment, the base member 92 includes a hole 96 and shoe pivot bearing surface 98A. The hole 96 receives a pin (e.g., coiled pin 76) to attach the second end 80 of the lever 75 to the shoe 90. In an example embodiment, the hole 96 can be located 10-20 mm (e.g., 16 mm) from shoe end bearing surface 98D that extends vertically and interfaces with the air piston assembly 55, and approximately 4-8 mm (e.g., 5 mm) below the top member 94. Other base member configurations will depend on a given configuration for other components of the air gun 10.

Adjacent to the hole 96 is the shoe pivot bearing surface 98A. In an example embodiment, the shoe pivot bearing surface 98A is a convex surface that contacts the 1 ever bearing surface 88 of the lever 75. Thus, shoe pivot bearing surface 98A is location at which the force of the lever 75 is applied to the shoe 90. The shoe pivot bearing surface 98A can have a surface area ranging from 10 to 80 sq. mm, depending on a given application. The shoe pivot bearing surface 98A can be a curved surface that has an arc of 177 degrees relative to a center of the hole 96. In other embodiments, the shoe pivot bearing surface 98A can be a profile surface that extends between 90 and 180 degrees, between 120 and 200 degrees, between 140 and 180 degrees, or between 170 and 190 degrees about the hole 96. In some other embodiments, the shoe pivot bearing surface 98A is a concave surface configured to receive a convex surface of the lever 75. The shoe pivot bearing surface 98A can also be configured such that its cross section is a combination of angled, rounded, contoured, tapered, or flat profiles that can be received by otherwise engage a corresponding surface of the lever 75. When configured as a combination of surfaces, the lever bearing surface 88 can also limit or otherwise prevent movement of the lever 75 relative to the shoe 90 in an axial direction, as previously described above. In some other embodiments, the shoe pivot bearing surface 98A can be a convex or concave surface having a cross-sectional profile that includes angled, rounded, contoured, tapered, or flat profiles. The shoe pivot bearing surface 98A can be of the same material as the remainder of the shoe 90, such as carbon or stainless steel, or of a different material. In some embodiments, the shoe pivot bearing surface 98A can be treated (e.g., with a black oxide or anodized coating) or untreated (e.g., a bare metal surface). In other cases, the shoe pivot bearing surface 98A can be plated (e.g., by an electroplating process) with a material (e.g., nickel or nickel-copper) to prevent surface damage (e.g., pitting scratches or wear) to the surface 98A that can occur over time. When assembled together, the shoe pivot bearing surface 98A is in tangential contact with lever bearing surface 88 of the lever 75. As a result, lever bearing surface 88 of the lever 75 slides tangentially along shoe pivot bearing surface 98A, as previously described herein. The shoe pivot bearing surface 98A, in some embodiments, can be machined with a radius that is smaller than a radius of the lever bearing surface 88 of the lever 75 to prevent interference between these surfaces at their remote ends (e.g., near a beginning and an end of each curved surfaces). In some other embodiments, the shoe pivot bearing surface 98A can include a rolling element bearing. Numerous other bearing surface configurations will be apparent in light of the present disclosure.

Attached to the base member 92 is a top member 94. The top member 94 supports the base member 92 and one end of the lever 75 based on its contact with the compression cylinder 50. In addition, the top member 94 contacts the air piston assembly 55, and thereby causes the assembly 55 to move within the compression cylinder 50. In an example embodiment, the top member 94 is a curved member that mates with a surface of the air piston assembly 55 and with an inner surface of the compression cylinder 50. In a general sense, note that the width of the top member 94 is constructed to be wide enough to prevent the shoe 90 from falling through a slot within the compression cylinder 50 in which the shoe 90 operates therein. The width of the top member 94, however, cannot be so large as to not allow the shoe 90 to pass through an opening within the compression cylinder 50 to install a portion of the shoe 90, as will be described further herein. The top member 94, in some embodiments, can have a width between 10 mm to 30 mm depending on the configuration of the air gun 10. In other embodiments, the top member 94 can be a ring which receives or otherwise surrounds an outer surface of the air piston assembly 55. As can be seen, the top member 94 includes the shoe bottom bearing surfaces 98B, the shoe top bearing surface 98C, the shoe end bearing surface 98D, and grooved features 102.

The top member 94 includes shoe bottom bearing surfaces 98B along opposite lower faces of the top member 94. The shoe bottom bearing surfaces 98*b* are configured to contact an inner surface of the compression cylinder 50. The shoe bottom bearing surfaces 98B support the shoe 90 and components attached thereto (e.g., one end of the lever 75). In addition, the shoe bottom bearing surfaces 98B also provide a smooth surface in which to contact an inner surface of the compression cylinder 50 to reduce friction between the shoe 90 and the compression cylinder 50. In an example embodiment, the shoe bottom bearing surfaces 98B are curved surfaces that correspond to or otherwise mate with an inner surface of the compression cylinder 50. In one example shown in FIG. 10, the shoe bottom bearing surfaces 98B extend from one end of the top member 94 to the other, but this may not be the case in all instances. In other instances, for example, the shoe bottom bearing surfaces 98B may extend along only a portion of the surface (e.g., 25%, 50% or 75% of the total surface) or comprise multiple smaller bearing surfaces positioned along the top member 94.

On an opposing side of the top member 94 from shoe bottom bearing surface 98B is the shot top bearing surface 98C. Shoe top bearing surface 98C is located along a top surface of the top member 94 and is configured to contact the air piston assembly 55. The shoe top bearing surface 98C provides a smooth surface with which the shoe 90 further contacts an outer surface of the air piston assembly 55 to allow the shoe 90 to move along the air piston assembly 55. In an example embodiment, the shoe top bearing surface 98C is a curved surface shaped to receive the outer cylindrical surface of a piston of the air piston assembly 55. In some embodiments, the shoe top bearing surface 98C is a surface machined with a radius between 12 mm to 16 mm. In yet other embodiments, the shoe top bearing surface 98C can be a flat surface that contacts or is otherwise received by a corresponding flat surface of the piston assembly 55.

The top member 94 of the shoe 90 further includes the shoe end bearing surface 98D to contact the air piston assembly 55 to move and compress a spring disposed in compression cylinder 50. In an example embodiment, the shoe end bearing surface 98D is a substantially vertical surface located along a rear end portion of shoe 90. The shoe end bearing surface 98D can include a radius at each end of the surface. The shoe end bearing surface 98D is configured to contact a surface (e.g., a machined feature such as a shoulder or step) of the air piston assembly 55, causing it to move horizontally in the compression cylinder 50. In some other embodiments, the shoe end bearing surface 98D can be angled or otherwise sloped to position the shoe top bearing surface 98C into closer contact with an outer surface of the piston in response to the shoe end bearing surface 98D contacting the air piston assembly 55 to move it within the compression cylinder 50. As can be seen, the shoe end bearing surface 98D can be the entire leading rear surface of shoe 90, but need not be in all cases. In some other embodiments, the shoe end bearing surface 98D may be a portion of the rear surface of shoe 90, for example multiple smaller bearing surfaces along the rear surface. Numerous other bearing surface configurations will be apparent in light of the present disclosure.

Located within the top member 94 and adjacent to the base member 92 are grooved features 102. The grooved features 102 are slots, grooves, channels or other structure that provides clearance between the shoe 90 and a slot within the compression cylinder 50, as will be described further herein. In an example embodiment, the grooved features 102 are located within a bottom surface of top member 94. As a result, the shoe 90 does not contact the edges of the slot during cocking and thus reduces friction between the shoe 90 and compression cylinder 50 during the cocking action. The grooved features 102 can be machined radius features that are positioned adjacent to the base member 92. In other embodiments, however, the grooved features 102 can be flat or recessed surface features that provide clearance for edges of the slot in the compression cylinder 50. As can be seen in FIG. 10, for example, the grooved features 102 extend longitudinally from one end of the shoe 90 to the other along its entire length. Note that the grooved features 102 can have any width sufficient to provide clearance with the edges of the slot within the compression cylinder 50. In this case, the grooved features can be machined with a radius of 0.3 mm. In other cases, note that the edges of the slot within the compression cylinder 50 can be machined with a radius, and thus the shoe 90 may not include grooved features 102. Numerous other shoe configurations will be apparent in light of the present disclosure.

Figure 14:
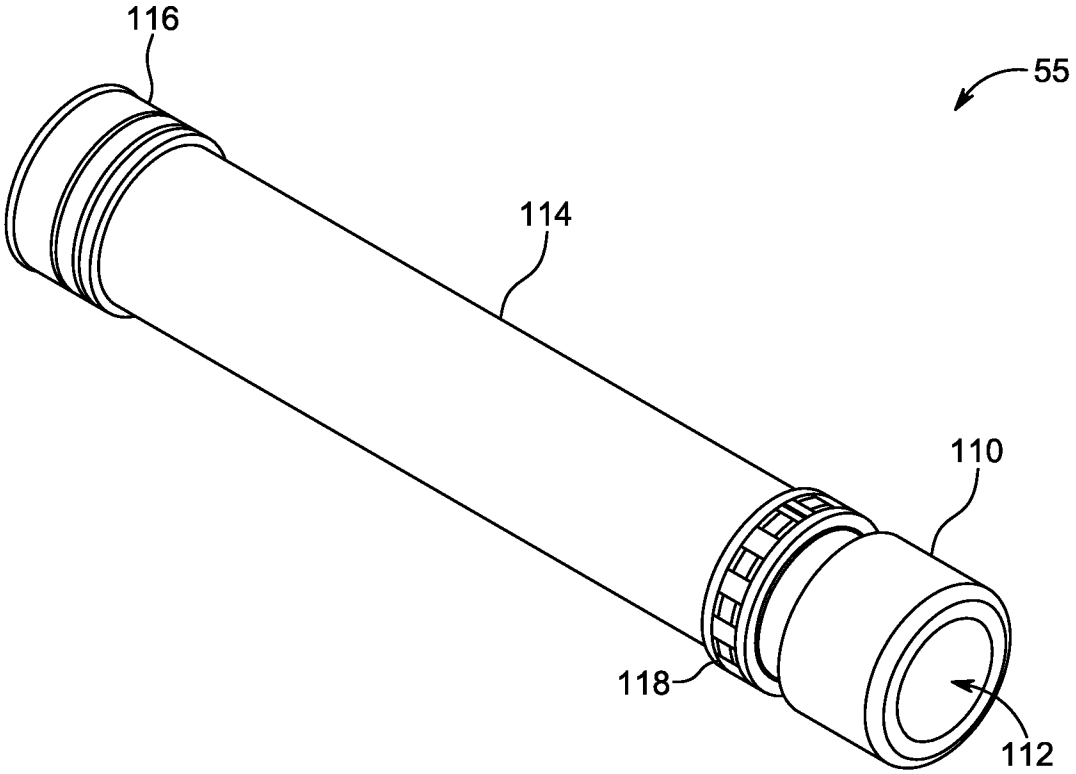
FIG. 14 is a perspective view of an air piston assembly shown in FIGS. 3 and 4, in accordance with an embodiment of the present disclosure.
Figure 15:
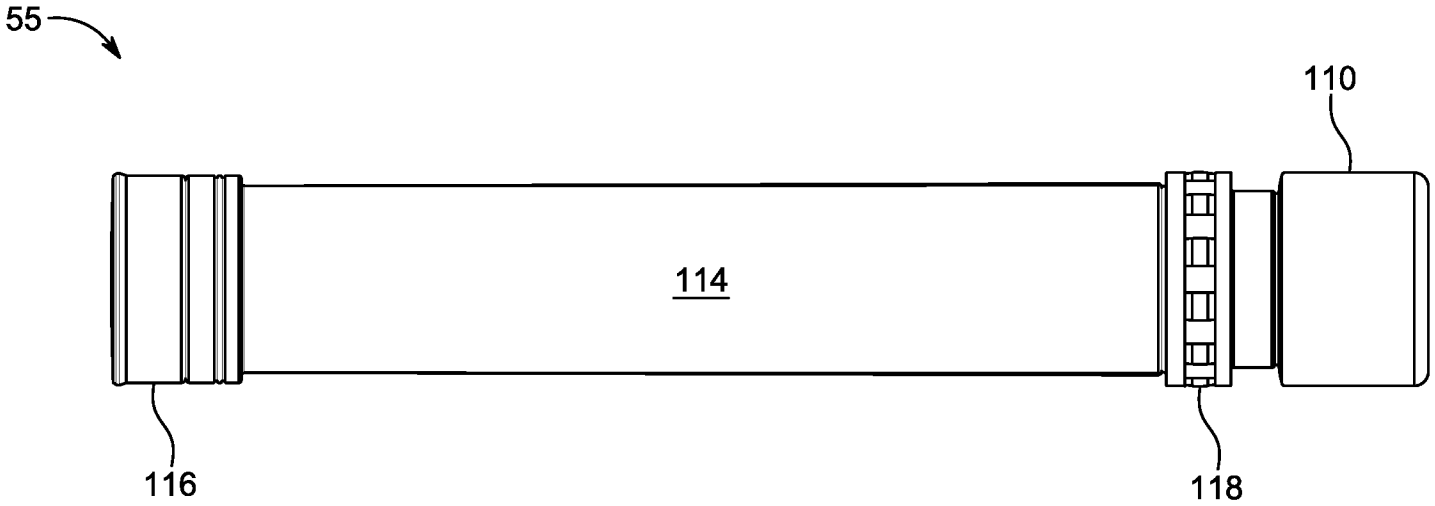
FIG. 15 is a side view of the air piston assembly shown in FIG. 14, in accordance with an embodiment of the present disclosure.

FIG. 14 is a perspective view of an air piston assembly 55 shown in FIG. 3, in accordance with an embodiment of the present disclosure. FIG. 15 is a side view of the air piston assembly 55 shown in FIG. 14. As previously described above, the shoe 90 contacts the air piston assembly 55 to position it in a ready-to-fire position in response to moving the lever 75. The air piston assembly 55, when released by the trigger mechanism 60, is configured to move within the compression cylinder 50 to fire the projectile, as previously described herein. In an example embodiment, the air piston assembly 55 includes a piston 110, a seal 116, and a bearing sleeve 118.

The air piston assembly 55 includes a piston 110 that is configured to move within the compression cylinder 50. In an example embodiment, the piston 110 is a cylindrical body that includes a cavity 112 to receive a spring or gas strut disposed within the compression cylinder 50. In some embodiments, the piston 110 can have a length between 185 mm to 187 mm. Other piston configurations will depend on a given application.

The piston 110 can include a surface 114 on which the shoe 90 is to contact and slide against. As can be seen, the surface 114 is an outer surface of a portion of the piston 110. The surface 114 can have a length sufficient to allow the shoe 90 to move therealong to position the piston 110 in the ready-to-fire position. In addition, the surface 114 is configured to allow the shoe 90 to be retracted to support operation of the air gun 10. In some embodiments, the surface 114 has a length from 125 mm to 130 mm. In addition, the surface 114 can be any diameter sufficient to allow the shoe 90 to be positioned between it and an inner surface of the compression cylinder 50. In this case, the surface 114 can have a diameter ranging from 26 mm to 27 mm. As can be seen, surface 114 is a smooth and uniform surface such that the piston 110 can be rotated within the compression cylinder 50 with the shoe 90 positioned therein. In more detail, since the shoe 90 is not captivated by or otherwise installed in the piston 110, the piston 110 can freely and independently rotate relative to the shoe 90. Thus, any torque applied to the piston 110 by the spring (or strut) as it is compressed, can be released by rotating the piston 110 without adversely affecting the operation of the shoe 90 (e.g., by increasing frictional forces). In some other cases, the surface 114 can include one or more flat surfaces configured to receive a flat of the shoe 90. In some such cases, the surface 114 can include a machined feature, such a keyway, in which to receive the shoe 90. Numerous other piston configurations will be apparent in light of the present disclosure.

The air piston assembly 55 further includes a seal 116. Disposed on a forward end of the piston 110, the seal 116 contacts the inner surface of the compression cylinder 50 to prevent air from escaping past the air piston assembly 55 as it moves during the firing cycle. In an example embodiment, the seal 116 is manufactured from a polymer such as polyurethane. Numerous other seal configurations will be apparent in light of the present disclosure.

Figure 16:
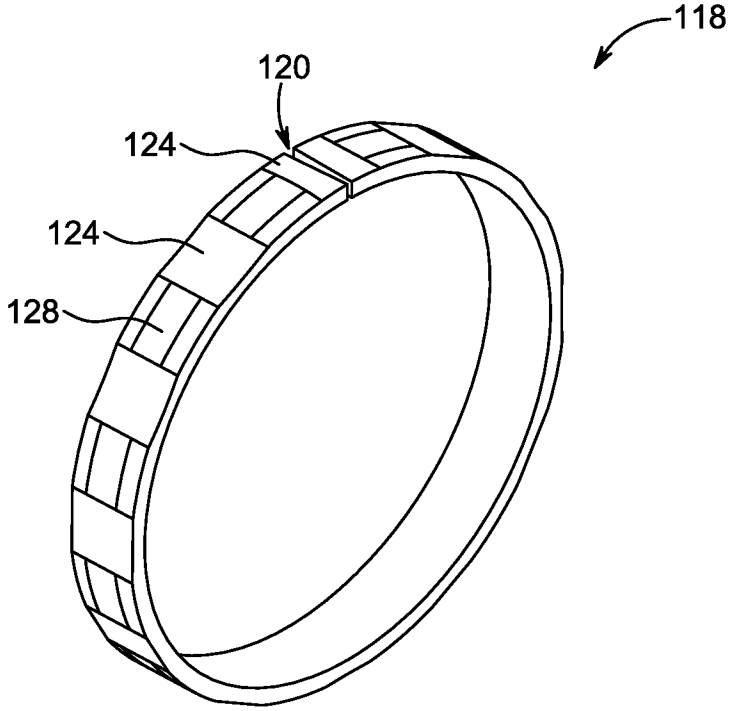
FIG. 16 is a perspective view of a bearing sleeve of the air piston assembly shown in FIG. 14, in accordance with an embodiment of the present disclosure.
Figure 17:
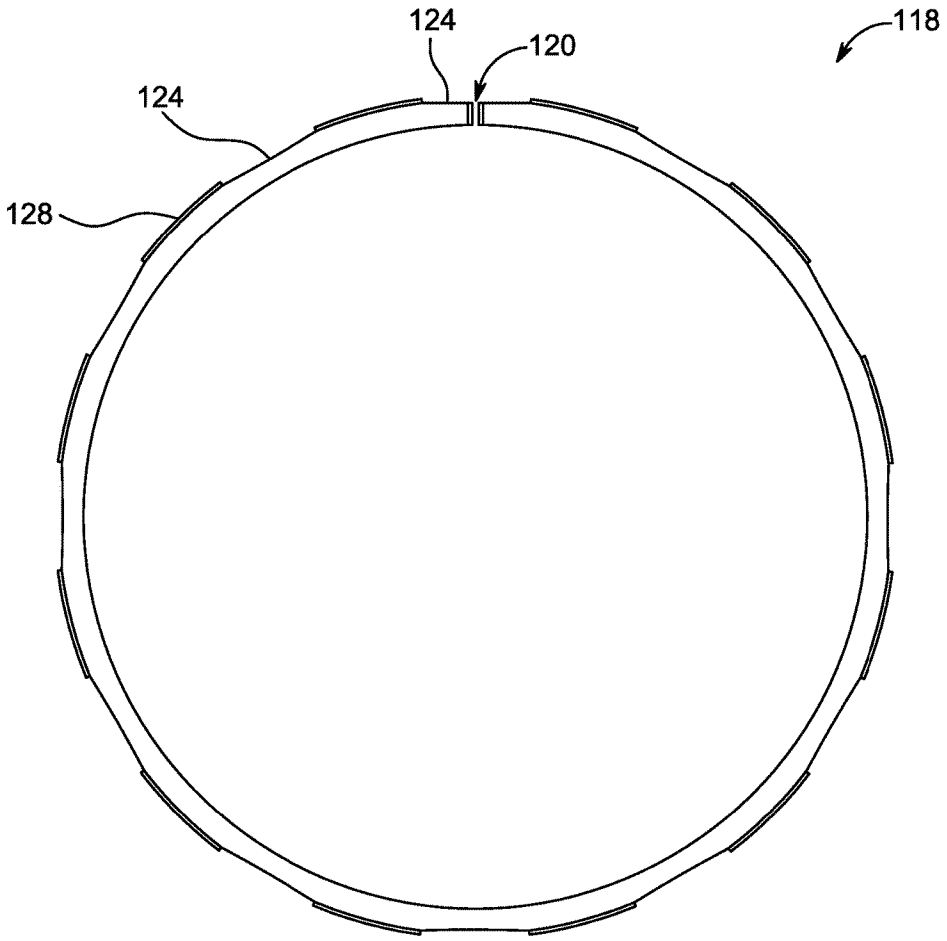
FIG. 17 is a front view of the bearing sleeve shown in FIG. 16, in accordance with an embodiment of the present disclosure.
Figure 18:
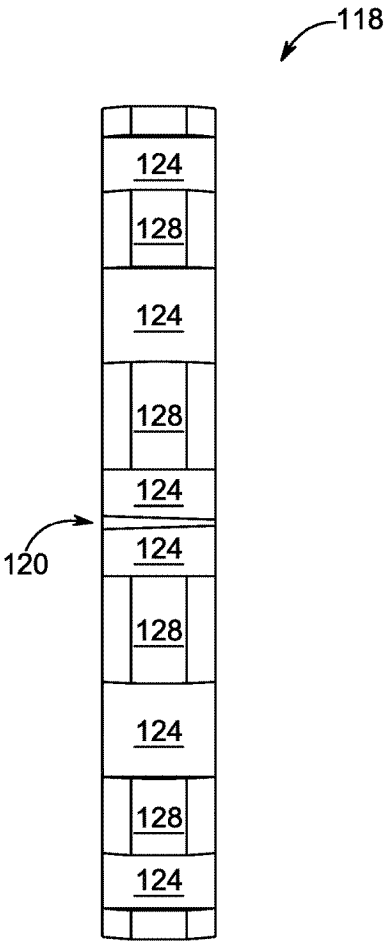
FIG. 18 is a top view of the bearing sleeve shown in FIG. 16, in accordance with an embodiment of the present disclosure.

FIG. 16 is a perspective view of a bearing sleeve 118 for the air piston assembly 55 shown in FIG. 14, in accordance with an embodiment of the present disclosure. FIG. 17 is a front view of the bearing sleeve 118 shown in FIG. 16. FIG. 18 is a top view of the bearing sleeve 118 shown in FIG. 16. Disposed near a rear end of the piston 110 is the bearing sleeve 118. The bearing sleeve 118 is configured to position the piston 110 within the compression cylinder 50. In more detail, the bearing sleeve 118 is positioned on the piston 110 to fill the gap between the piston 110 and the compression cylinder 50. As a result, the piston 110 is positioned relative to the compression cylinder 50 by the bearing sleeve 118 (e.g., the bearing sleeve 118 centers the piston 110 within the compression cylinder 50). Moreover, the bearing sleeve 118 maintains the air piston assembly 55 in that position as the lever 75 is rotated about the shoe 90. In particular, the bearing sleeve 118 prevents the piston 110 from moving vertically within the compression cylinder 50 due to forces applied by the shoe 90 and lever 75. When installed on the piston 110, the bearing sleeve 118 extends beyond the piston 110 to contact the compression cylinder 50, as previously described. As a result, bearing sleeve 118 is in sliding contact with the compression cylinder 50 to prevent or otherwise limit the contact between the piston 110 and the inner surface of the compression cylinder 50. The bearing sleeve 118 can be made of low friction, wear-resistant material, such as acetal resin (e.g., DELRIN®), to allow it to travel along the inner surface of the compression cylinder 50 without causing damage thereto.

In an example embodiment, the bearing sleeve includes a split 120, relief surfaces 124, and sleeve bearing surfaces 128. The split 120 enables the bearing sleeve 118 to be installed upon the piston 110, such that the bearing sleeve 118 wraps around or otherwise surrounds a portion of the piston 110, as shown in FIGS. 14 and 15. As can be seen, the split 120 can be located at a top of the bearing sleeve 118. In some cases, the split 120 can be tapered, angled or straight. Adjacent to the split 120 are relief surfaces 124 and sleeve bearing surfaces 128. In an example embodiment, the relief surfaces 124 and sleeve bearing surfaces 128 are arranged in an alternating pattern around a circumference of the bearing sleeve 118. The relief surfaces 124 provide clearance between the bearing sleeve 118 and the compression cylinder 50 to reduce resistance as the piston 110 slides along the inner surface of the compression cylinder due to any particulate or contamination present in that portion of the compression cylinder 50. As can be seen, the bearing sleeve 118 may include twelve relief surfaces 124 (note the relief surface 124 that contains the split 120 is in two pieces). In other embodiments, however, the relief surfaces 124 may be smaller or larger, and thus increase or decrease the number of relief surfaces 124 on the bearing sleeve 118 depending on a given configuration of the air gun 10.

Adjacent to the relief surfaces 124 are sleeve bearing surfaces 128. The sleeve bearing surfaces 128 contact the compression cylinder 50 to align the piston 110 therewith. In addition, the sleeve bearing surfaces 128 provide contact surfaces on which the bearing sleeve 118 interfaces with the inner surface of the compression cylinder 50. As can be seen, the sleeve bearing surfaces 128 are raised surfaces in relation to the relief surfaces 124. In an example embodiment, the sleeve bearing surfaces 128 can be arranged along a circumference of the bearing sleeve 118 in an alternating fashion with the relief surfaces 124, but this may not be the case for all instances. In other instances, for example, the sleeve bearing surfaces 128 may be disposed at a fewer or a greater number of positions along a circumference of the bearing sleeve 118 depending on a given application. In some embodiments, the sleeve bearing surfaces 128 can be tapered such that a portion of the sleeve bearing surface 128 located near the center of the surface contacts the compression cylinder 50. Numerous other bearing sleeve configurations will be apparent in light of the present disclosure.

Figure 19:
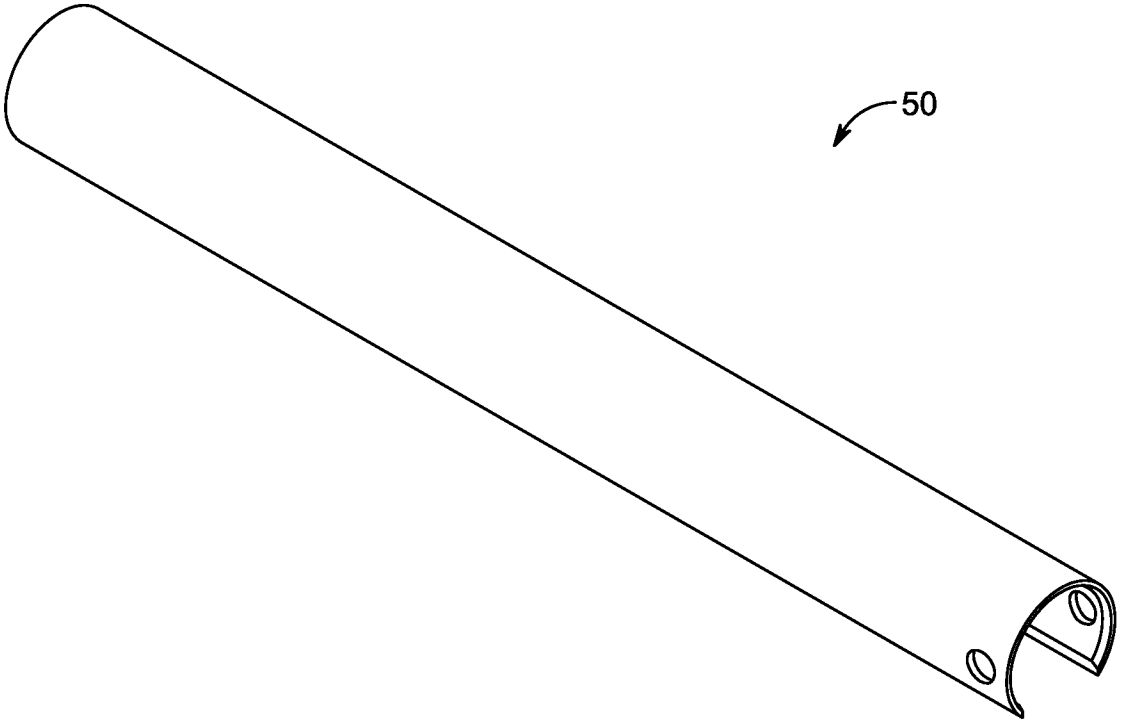
FIG. 19 is a perspective view of a compression cylinder of the action assembly shown in FIG. 2, in accordance with an embodiment of the present disclosure.
Figure 20:
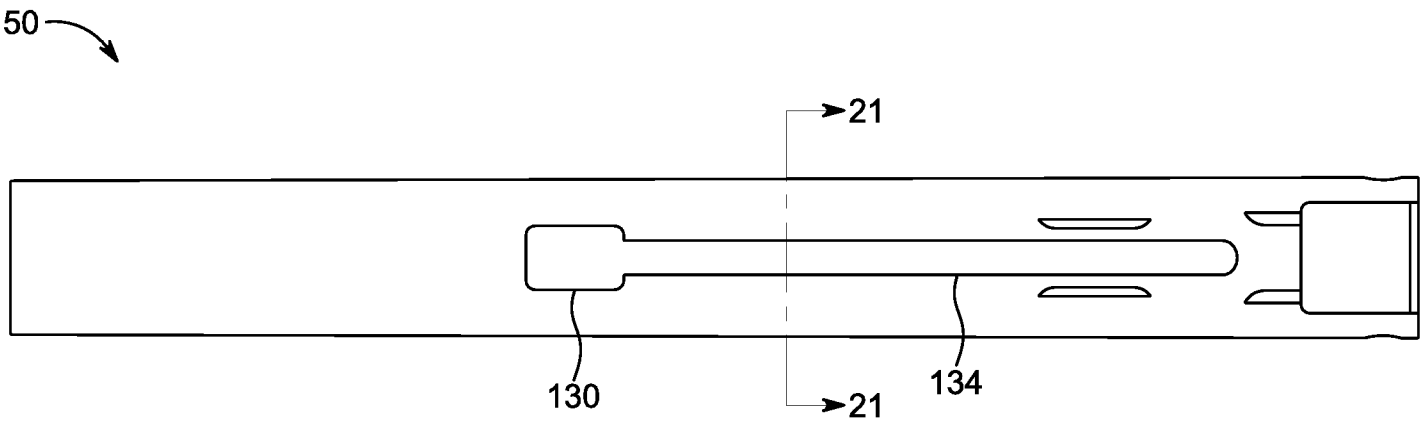
FIG. 20 is a bottom view of the compression cylinder shown in FIG. 19, in accordance with an embodiment of the present disclosure.
Figure 21:
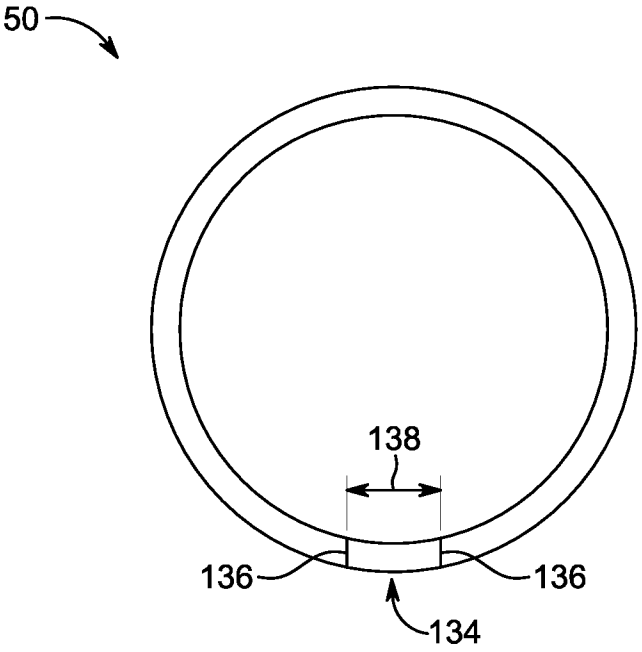
FIG. 21 is a cross-sectional view of the compression cylinder shown in FIG. 20, in accordance with an embodiment of the present disclosure.

FIG. 19 is a perspective view of a compression cylinder 50 of the action assembly 20 shown in FIG. 2, in accordance with an embodiment of the present disclosure. FIG. 20 is a bottom view of the compression cylinder 50 shown in FIG. 19. FIG. 21 is a cross-sectional view of the compression cylinder 50 shown in FIG. 19. Attached to the barrel 40 is a compression cylinder 50. The compression cylinder 50 is configured to house or otherwise contain the air piston assembly 55, and to guide the movement of the shoe 90 of the cocking linkage assembly 70. In an example embodiment, the compression cylinder 50 includes opening 130 and slot 134. The opening 130 enables the shoe 90 to be positioned within the compression cylinder 50. In a general sense, the opening 130 can be any size sufficient to allow the shoe 90 to pass therethrough. In some embodiments, the opening 130 can have a width between 13 mm to 17 mm. As can be seen, the opening 130 can have a cross-sectional shape of a rectangle so as to enable the top member 94 of the shoe 90 to pass through. In other embodiments, however, the opening 130 can have cross-sectional shapes other than a rectangle, such as a square, circle or oval. No matter its configuration, the opening 130 is located adjacent to the slot 134 such that the shoe 90 can move from the opening 130 to the slot 134 within the compression cylinder 50.

The compression cylinder 50 also includes the slot 134 and is configured for the shoe 90 to move about therein. In general sense note that the slot 134 is configured to enable the shoe 90 to reset the air gun 10 for the next firing cycle. In an example embodiment, the slot 134 is to have a length sufficient to allow the shoe 90 to position the air piston assembly 55 in the ready-to-fire position, but also to allow the shoe 90 to be retracted within the compression cylinder 50 so as to provide clearance for the air piston assembly 55 during the firing cycle. Note that in the retracted position the shoe 90 is to be located forward of the opening 130 to prevent the shoe 90 from passing therethrough, and thus out of the compression cylinder 50. The slot 134, in this example embodiment, can have a length of 135.5 mm. In some other embodiments, the length of the slot 134 can range from 125 mm to 160 mm.

As can be seen, the slot 134 is includes vertical surfaces 136 and a gap 138. The vertical surfaces 136 define the slot 134 and are produced by milling or otherwise machining to remove a portion of the compression cylinder 50. As can be seen, the vertical surfaces 136 are straight, but this may not be the case in all instances. In other cases, the vertical surfaces 136 may include taper or other machined features, such as a radius, to provide clearance with other components (e.g., the shoe 90). The slot 134 also includes a gap 138 that is sufficient to receive the base member 92 of the shoe 90. In general, the gap 138 is sufficiently large to allow the shoe 90 to move about therein without contacting vertical surfaces 136. Such contact can result in frictional drag, making the air gun 10 more difficult to operate. In this case, the gap 138 can include a width of 6.5 mm. In some other cases, the slot can range from 3 mm to 15 mm. Numerous other compression cylinder configurations will be apparent in light of the present disclosure.

Example Air Gun Operation

Figure 22:
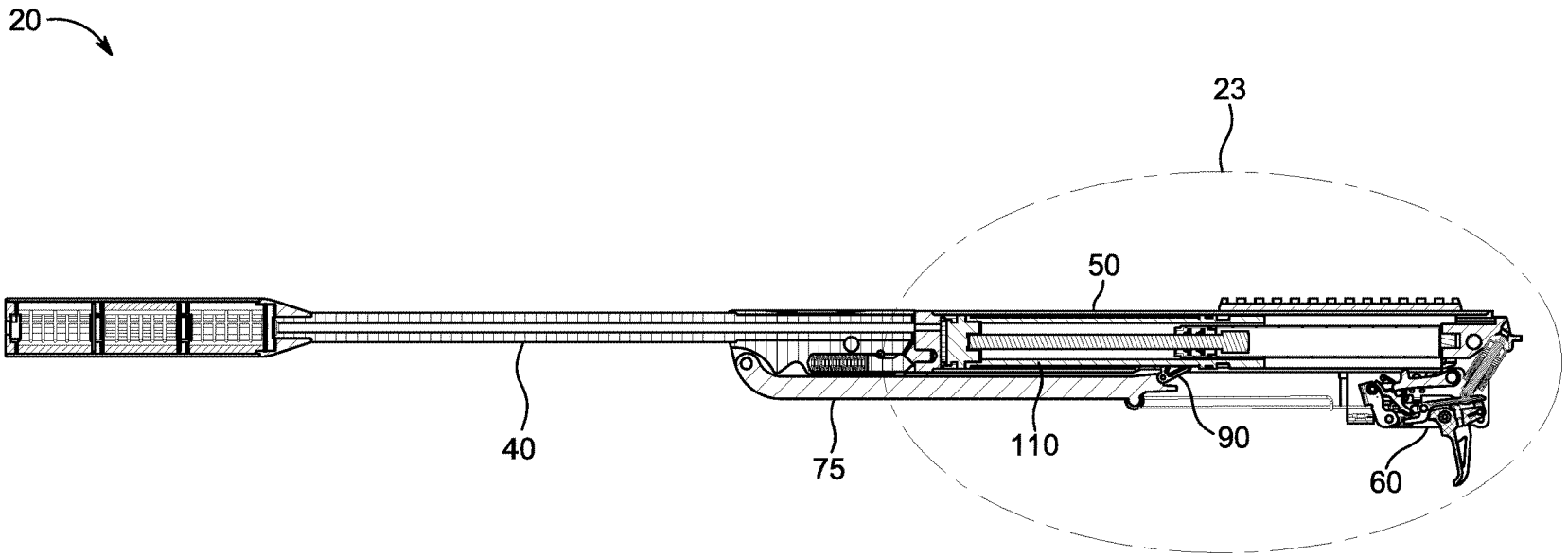
FIG. 22 is a cross-sectional view of the action assembly configured in a fired position, in accordance with an embodiment of the present disclosure.
Figure 23:
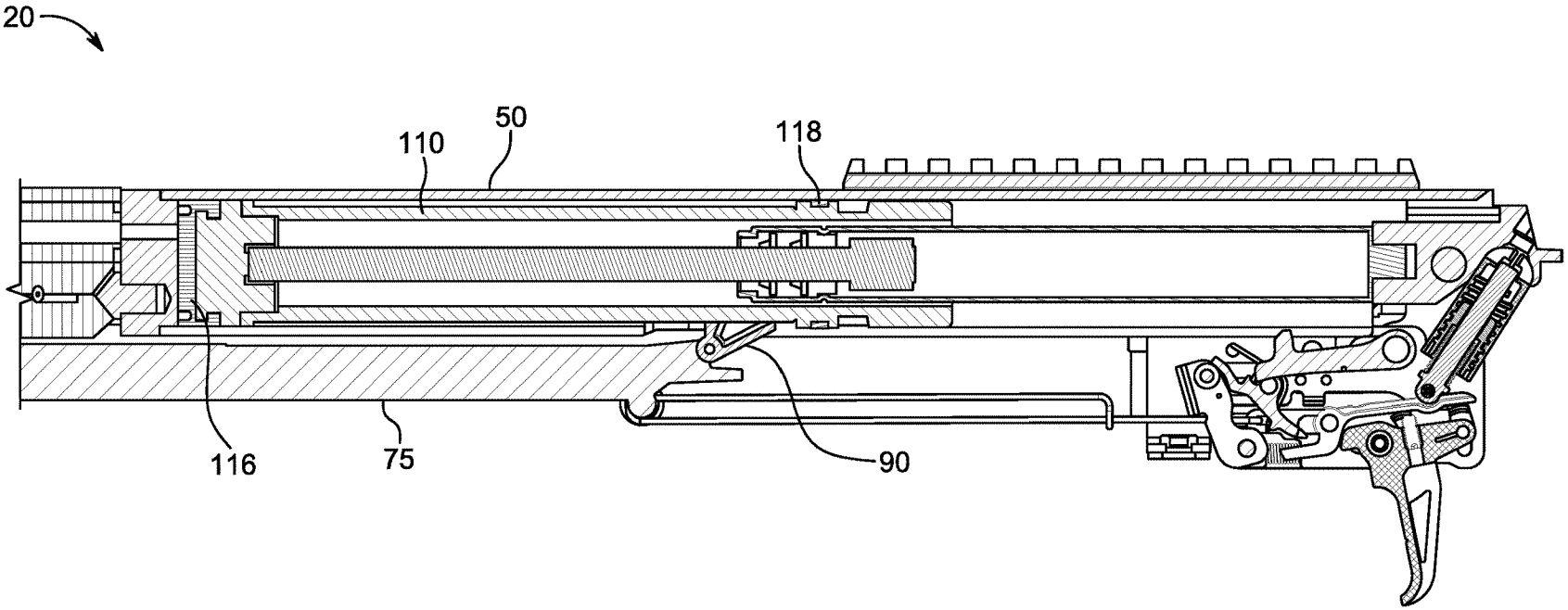
FIG. 23 is an enlarged view of a portion of the action assembly shown in FIG. 22, in accordance with an embodiment of the present disclosure.

FIG. 22 is a cross-sectional view of the action assembly 20 configured in a fired position, in accordance with an embodiment of the present disclosure. FIG. 23 is an enlarged view of a portion of the action assembly 20 shown in FIG. 22. In the fired position, the barrel 40 is fully rotated upward and in-line with the compression cylinder 50. The lever 75 attached to the barrel 40 is positioned substantially parallel to the compression cylinder 50 and barrel 40. The shoe 90 attached to the lever 75 is positioned within a forward portion the compression cylinder 50 and in contact with an outside surface of the piston 110. As can be seen, the piston 110 is not engaged by the trigger mechanism 60. To ready the air gun 10 for operation, the barrel breech is to be loaded and the piston 110 is to be re-positioned to engage the trigger mechanism 60.

Figure 24:
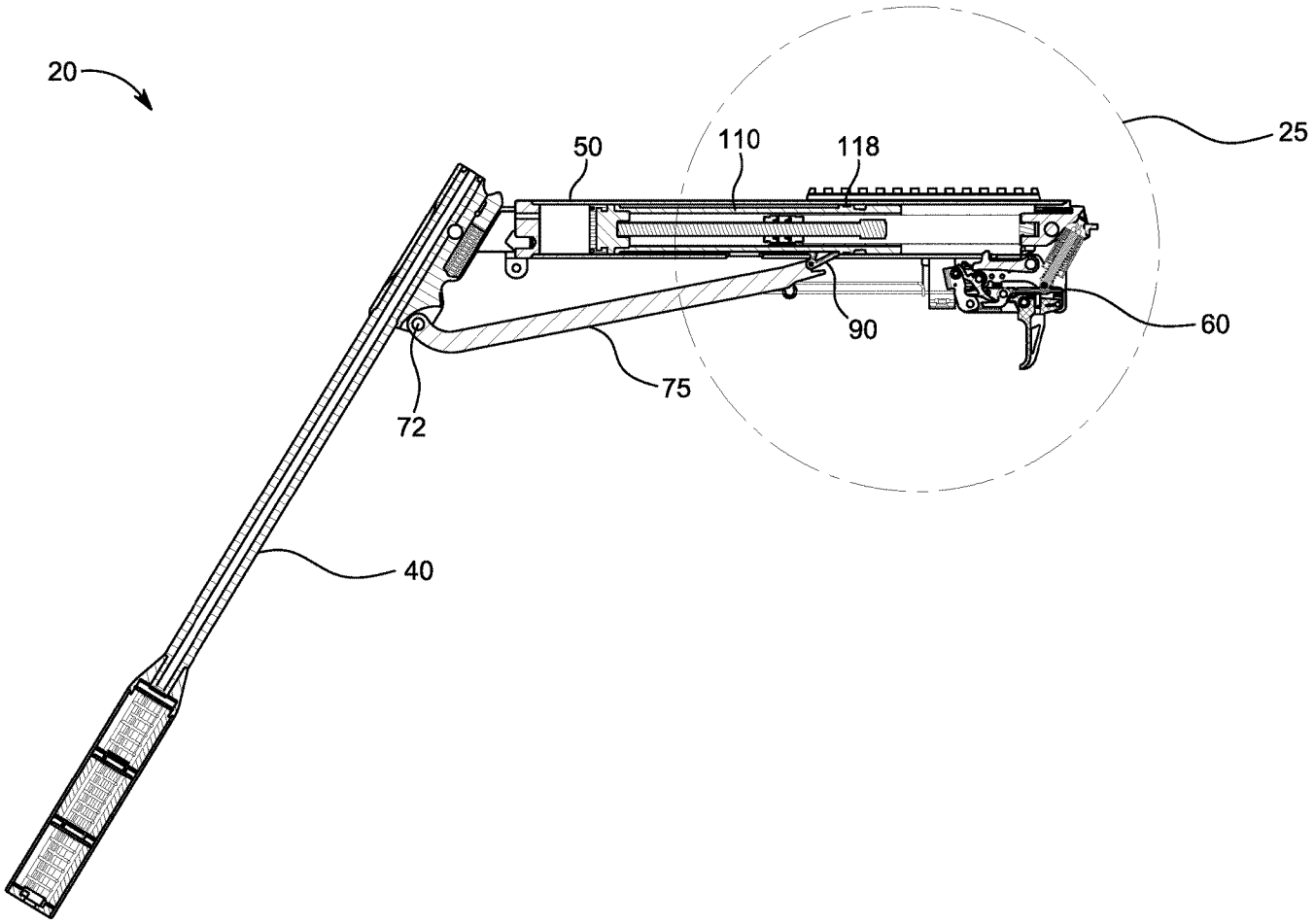
FIG. 24 is a cross-sectional view of the action assembly configured with the barrel rotated slightly downward, in accordance with an embodiment of the present disclosure.
Figure 25:
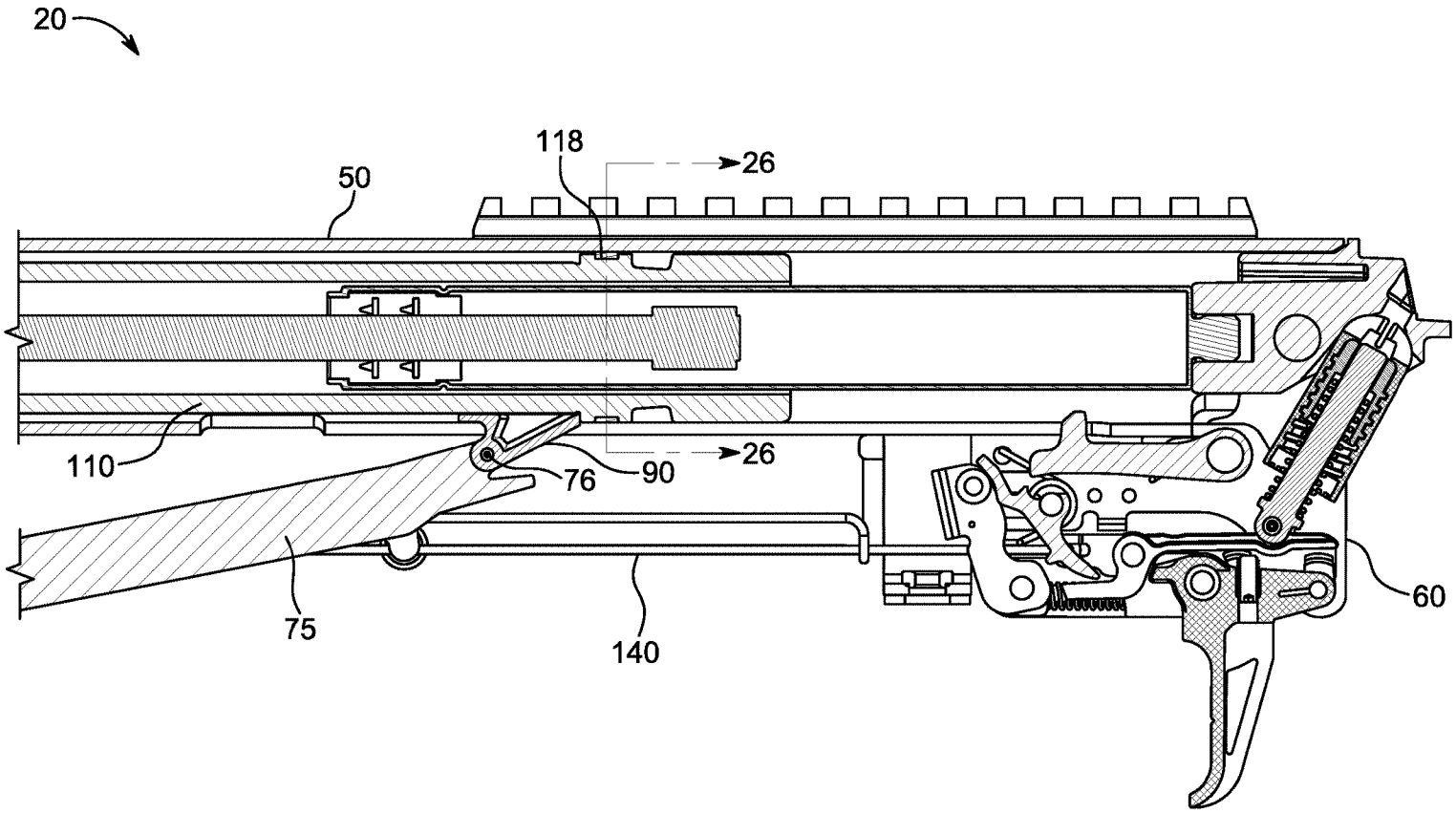
FIG. 25 is an enlarged view of a portion of the action assembly shown in FIG. 24, in accordance with an embodiment of the present disclosure.
Figure 26:
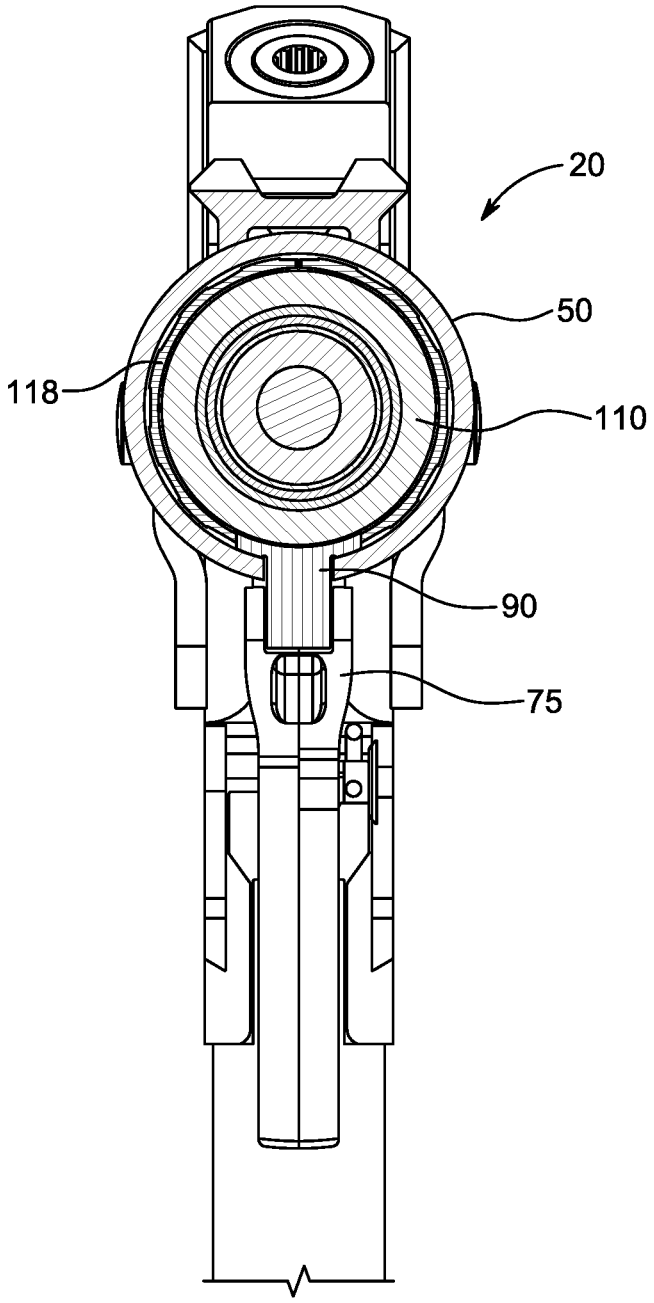
FIG. 26 is another cross-sectional view of the action assembly shown in FIG. 25, in accordance with an embodiment of the present disclosure.

FIG. 24 is a longitudinal cross-sectional view of an action assembly 20 with the barrel 40 slightly rotated downward, in accordance with an embodiment of the present disclosure. FIG. 25 is an enlarged view of a portion of the action assembly 20 shown in FIG. 24. FIG. 26 is a transverse cross-sectional view of an action assembly 20 shown in FIG. 25. To load the air gun 10, the user performs a cocking action to rotate the barrel 40 downward to expose a breech end of the barrel 40 to install a projectile, such as a pellet, therein. The cocking action also generates potential mechanical energy by moving the piston 110 to compress a spring or strut disposed within the compression cylinder 50. In more detail, with barrel 40 rotated slightly downward, the lever 75 begins to rotate, and in turn causes the shoe 90 to move in a first direction parallel to the direction of piston travel (e.g., backwards or away from the muzzle) along the outer surface of the piston 110. As the shoe 90 moves, it contacts another portion of the piston 110, for instance a machined step or shoulder, at one end of the outer surface. As the lever 75 continues to rotate downward and is pushed backward, the shoe 90 moves the piston 110 backward along the inner surface of the compression cylinder 50 to create a space within a forward end of the compression cylinder 50. As the spring is compressed, the piston 110 (or entire air piston assembly 55) may slightly rotate within the compression cylinder 50 along a curved surface of the shoe 90, as previously described. Thus, there is little or no increase in friction forces that oppose the cocking action due to compressing the spring. The piston 110, however, has not yet moved to a position to engage the trigger mechanism 60.

Figure 27:
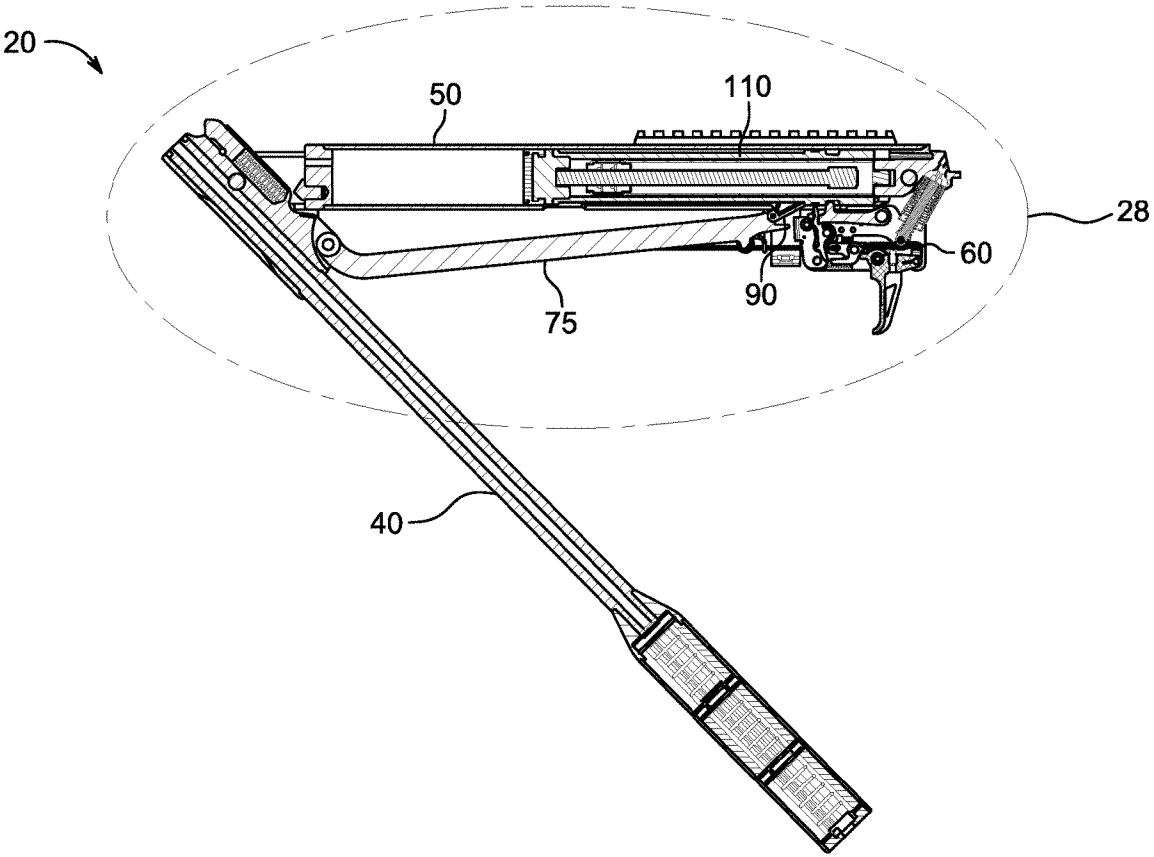
FIG. 27 is a cross-sectional view of the action assembly configured with the barrel fully rotated, in accordance with an embodiment of the present disclosure.
Figure 28:
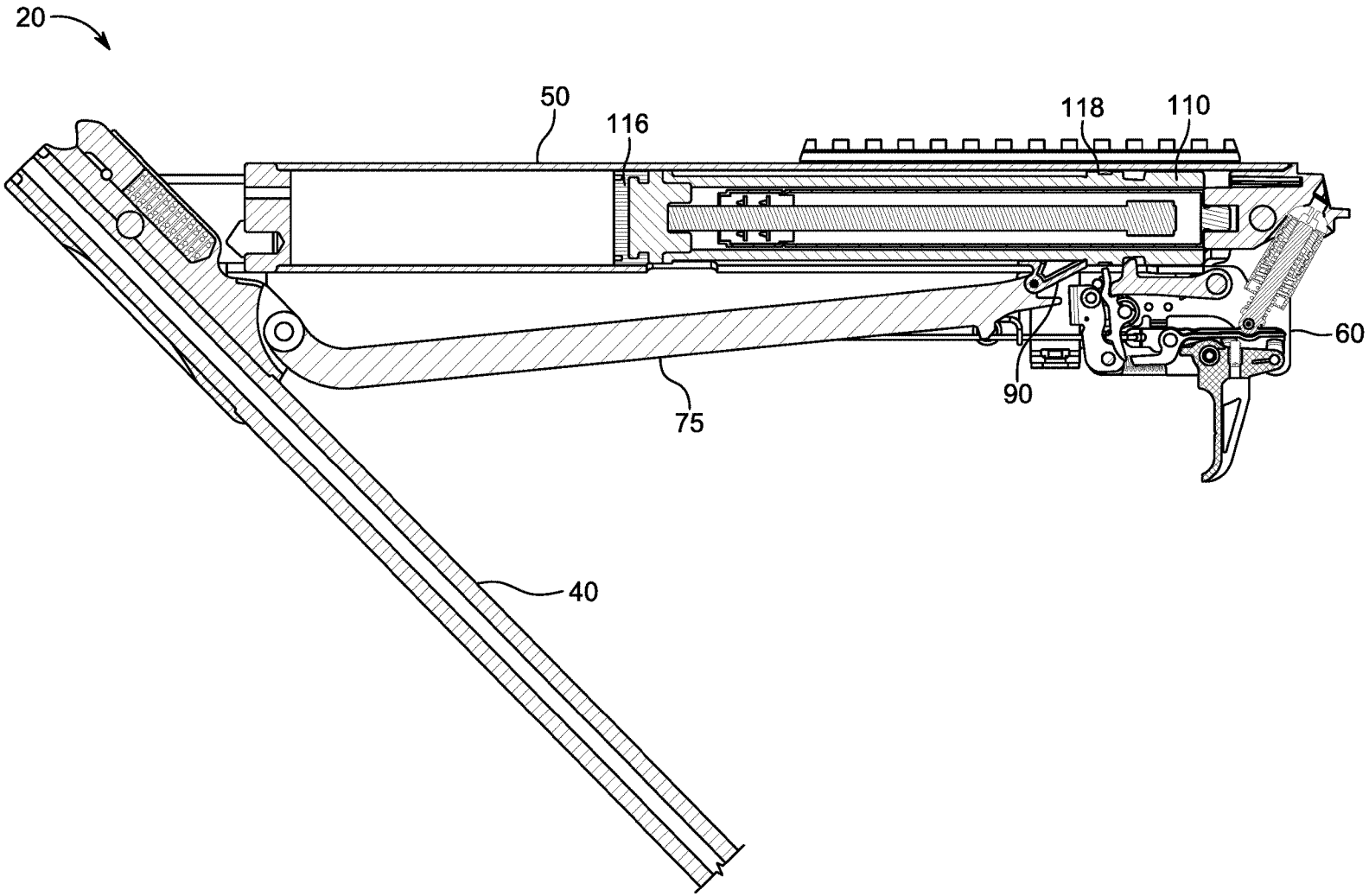
FIG. 28 is an enlarged view of a portion of the action assembly shown in FIG. 27, in accordance with an embodiment of the present disclosure.

FIG. 27 is a cross-sectional view of the action assembly 20 with the barrel 40 fully rotated, in accordance with an embodiment of the present disclosure. FIG. 28 is an enlarged view of a portion of the action assembly 20 shown in FIG. 27. As can be seen, the lever 75 is moved fully backward, and thus piston 110 is positioned as far back as possible within the compression cylinder 50. In this position, the trigger mechanism 60 can engage the piston 110 and prevent it from moving forward. The air gun, however, is not ready to be fired because the barrel 40 is not aligned with the compression cylinder 50. In addition, the shoe 90 is positioned within the cylinder such that if piston 110 were to move forward it would contact the shoe 90 and thus be prevented from completing the firing cycle. Thus, the cocking action is not yet complete.

Figure 29:
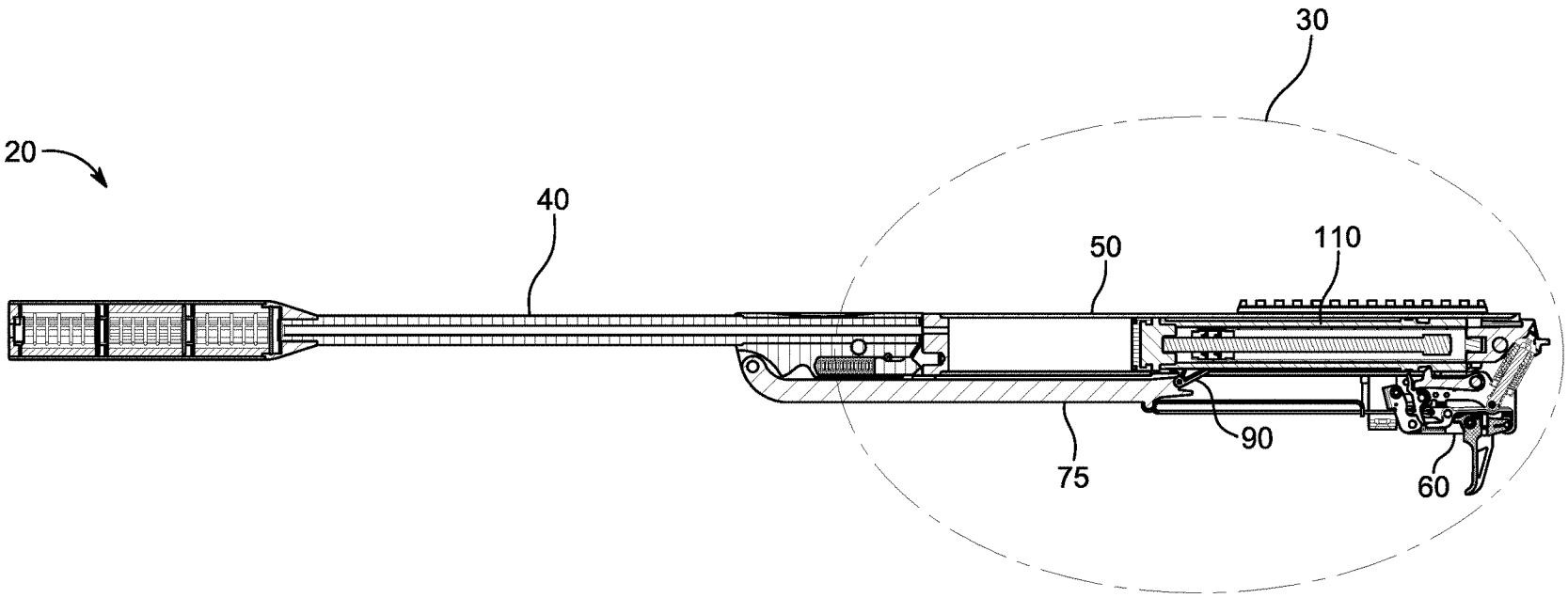
FIG. 29 is a cross-sectional view of the action assembly configured in a ready-to-fire position, in accordance with an embodiment of the present disclosure.
Figure 30:
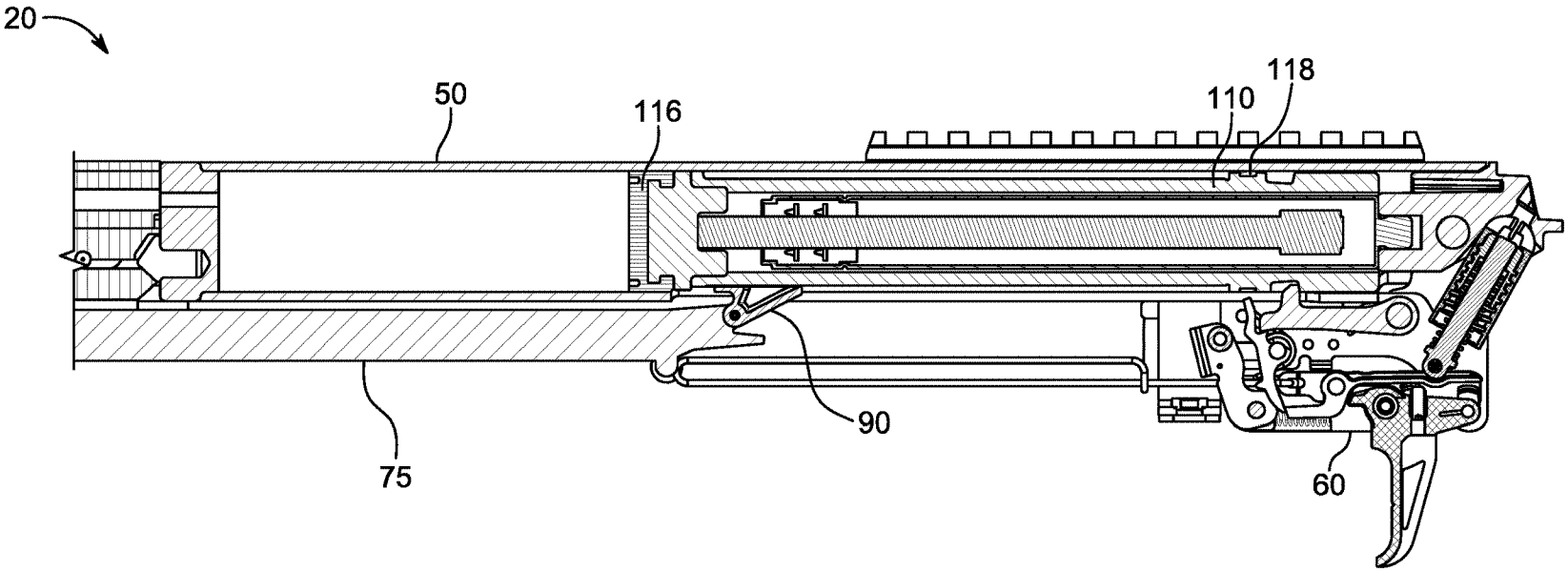
FIG. 30 is an enlarged view of a portion of the action assembly shown in FIG. 29, in accordance with an embodiment of the present disclosure.

FIG. 29 is a cross-sectional view of the action assembly 20 configured in a ready-to-fire position, in accordance with an embodiment of the present disclosure. FIG. 30 is an enlarged view of a portion of the action assembly 20 shown in FIG. 29. With the piston 110 held in position by the trigger mechanism 60, the lever 75 can be rotated upwards causing the shoe 90 to move along the outer surface of the piston 110 in a second direction opposite the first direction (e.g., forwards or towards the muzzle). As can be seen, this operation completes the cocking action by positioning the barrel 40 in line with the compression cylinder. In addition, the shoe 90 is retracted to a forward location within the compression cylinder 50 at which it provides clearance to operate the piston during the firing cycle.

Alternative Cocking Linkage Configuration

Figure 31:
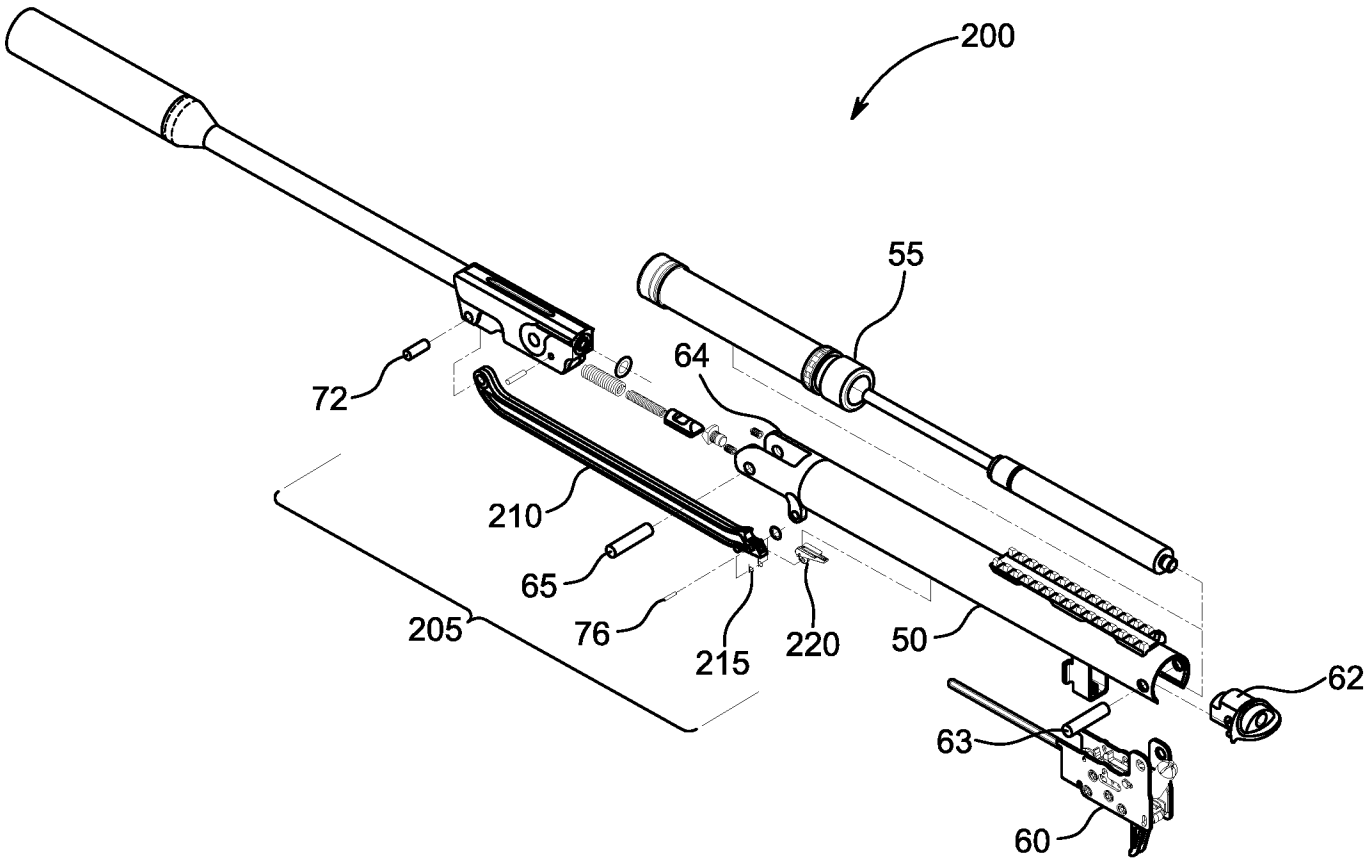
FIG. 31 is an exploded view of an action assembly, in accordance with another embodiment of the present disclosure.

Numerous other cocking linkage assembly configurations for use with break barrel air guns will be apparent in light of this disclosure. For example, the curved surfaces of the lever and shoe may not be concentric with the pin that secures the lever to the shoe. In more detail, FIG. 31 is an exploded view of an action assembly 200, in accordance with another embodiment of the present disclosure. As can be seen, the barrel 40 is attached to a cocking linkage assembly 205. The cocking linkage assembly 205 is constructed and arranged to operate the air piston assembly 55 in a fashion similar to cocking linkage assembly 70, previously described herein. The cocking linkage assembly 205, in this embodiment, includes a lever 210 attached to the barrel 40 using pin 72 at one end. The other end of the lever 210 is attached to the shoe 220. A portion of the shoe 220 is disposed within the walls of compression cylinder 50 in a fashion similar as described in relation to shoe 90.

Figure 32:
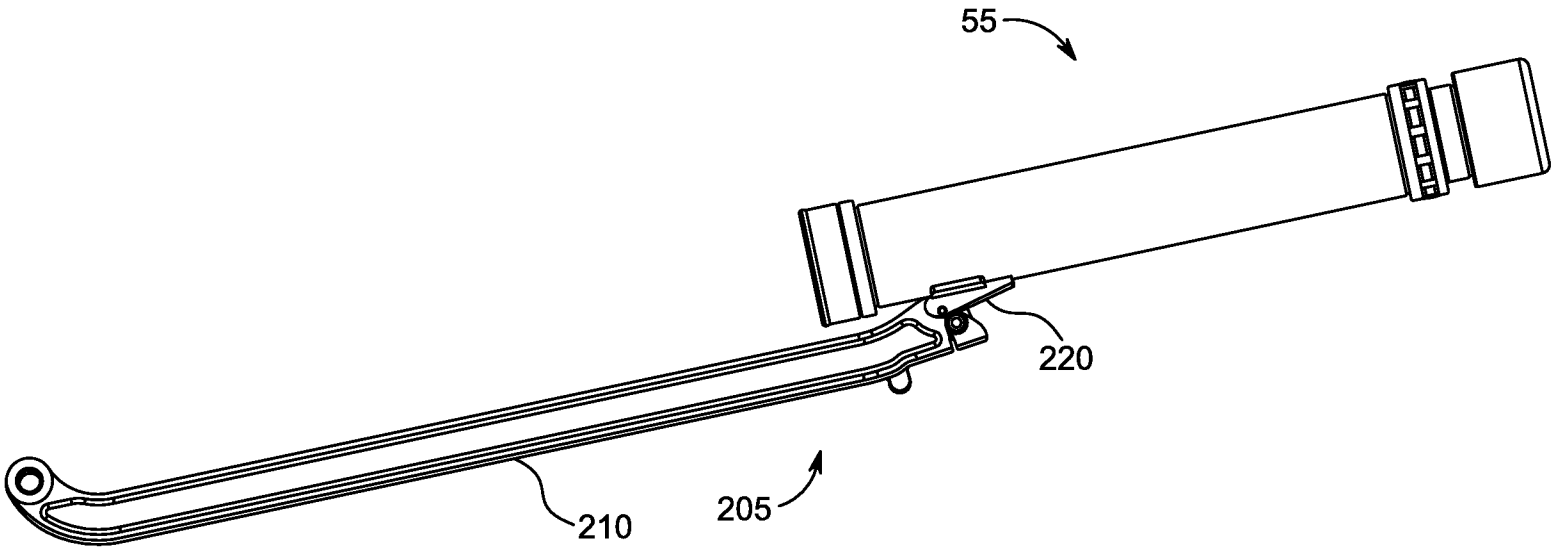
FIG. 32 is a perspective view of the cocking linkage assembly and air piston assembly shown in FIG. 31, in accordance with an embodiment of the present disclosure.
Figure 33:
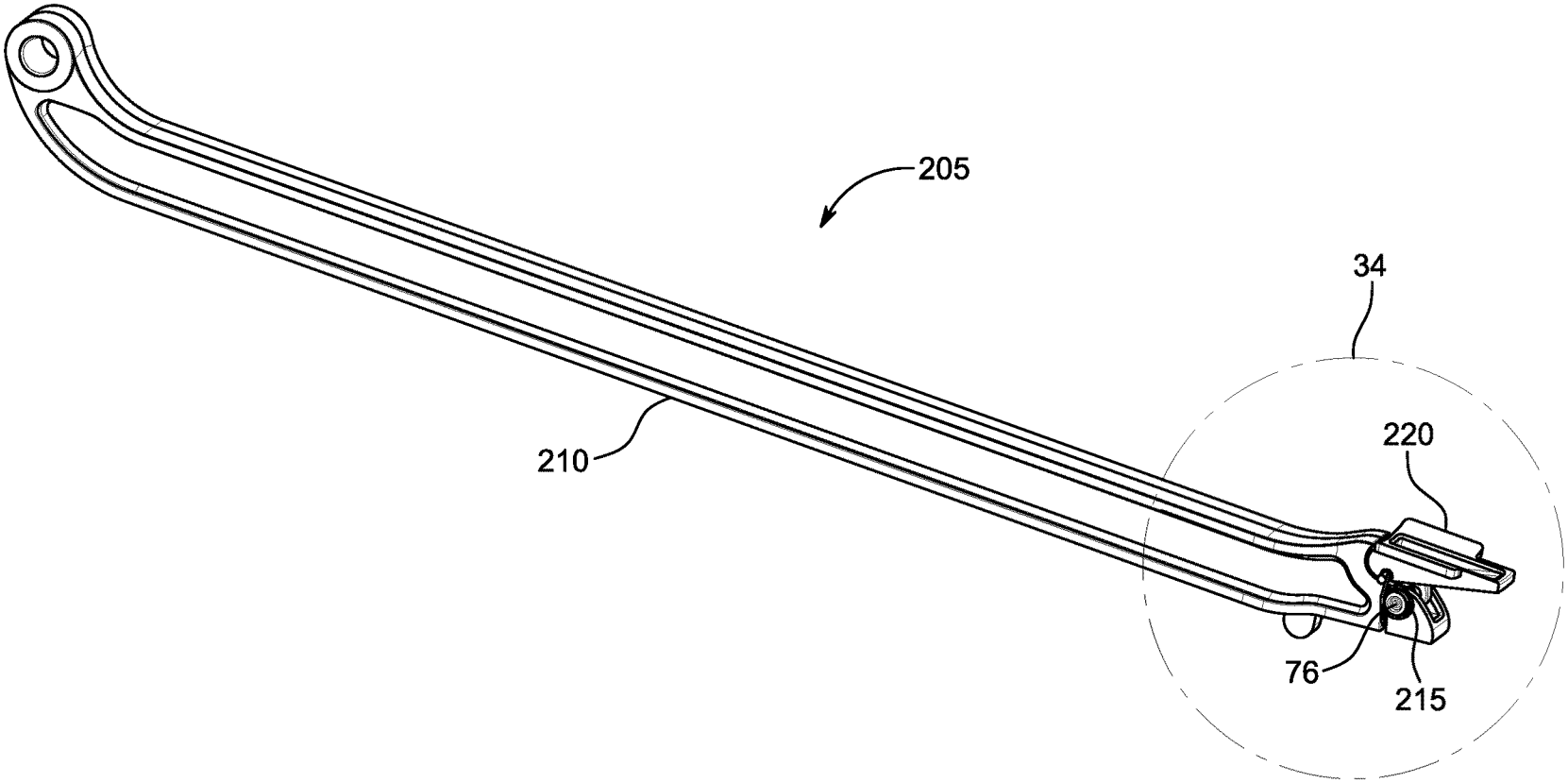
FIG. 33 is a perspective view of the cocking linkage assembly shown in FIG. 32, in accordance with an embodiment of the present disclosure.
Figure 34:
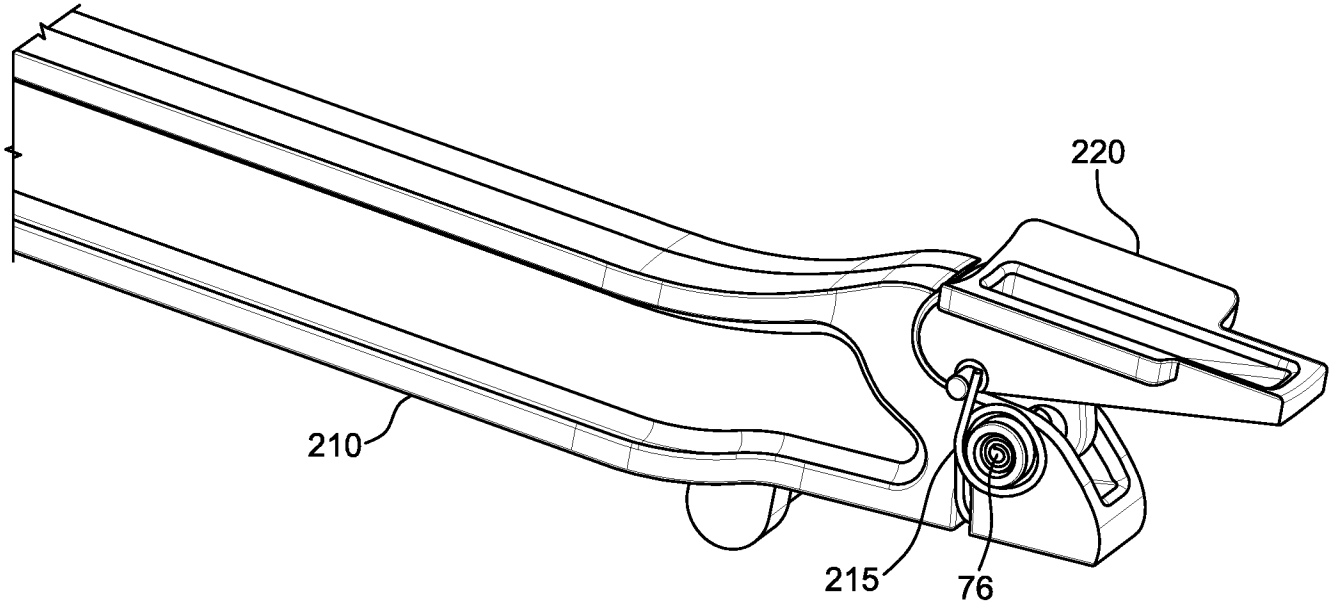
FIG. 34 is an enlarged view of a portion of the cocking linkage assembly shown in FIG. 33, in accordance with an embodiment of the present disclosure.

FIG. 32 is a perspective view of the cocking linkage assembly 205 and air piston assembly 55 shown in FIG. 31, in accordance with an embodiment of the present disclosure. FIG. 33 is a perspective view of the cocking linkage assembly 205 shown in FIG. 32. FIG. 34 is an enlarged view of a portion of the cocking linkage assembly 205 shown in FIG. 33. As can be seen, the cocking linkage assembly 205 includes a lever 210 and a shoe 220 attached thereto with a pin 76 and spring 215. The lever 210 transmits the force applied by the user at the barrel during the cocking action to the shoe 220 in a manner similar to the interface between lever 75 and shoe 90, described herein. The pin 76 (e.g., a coil pin) and spring 215 (e.g., a torsion spring) ensure that the lever 210 and shoe 220 remain coupled together and do not become separated from another as the lever 75 is rotated upward. As can be seen, the spring 215 can be installed on the lever 210 and in contact with shoe 220. Numerous other linkage configurations will be apparent in light of the present disclosure.

Figure 35:
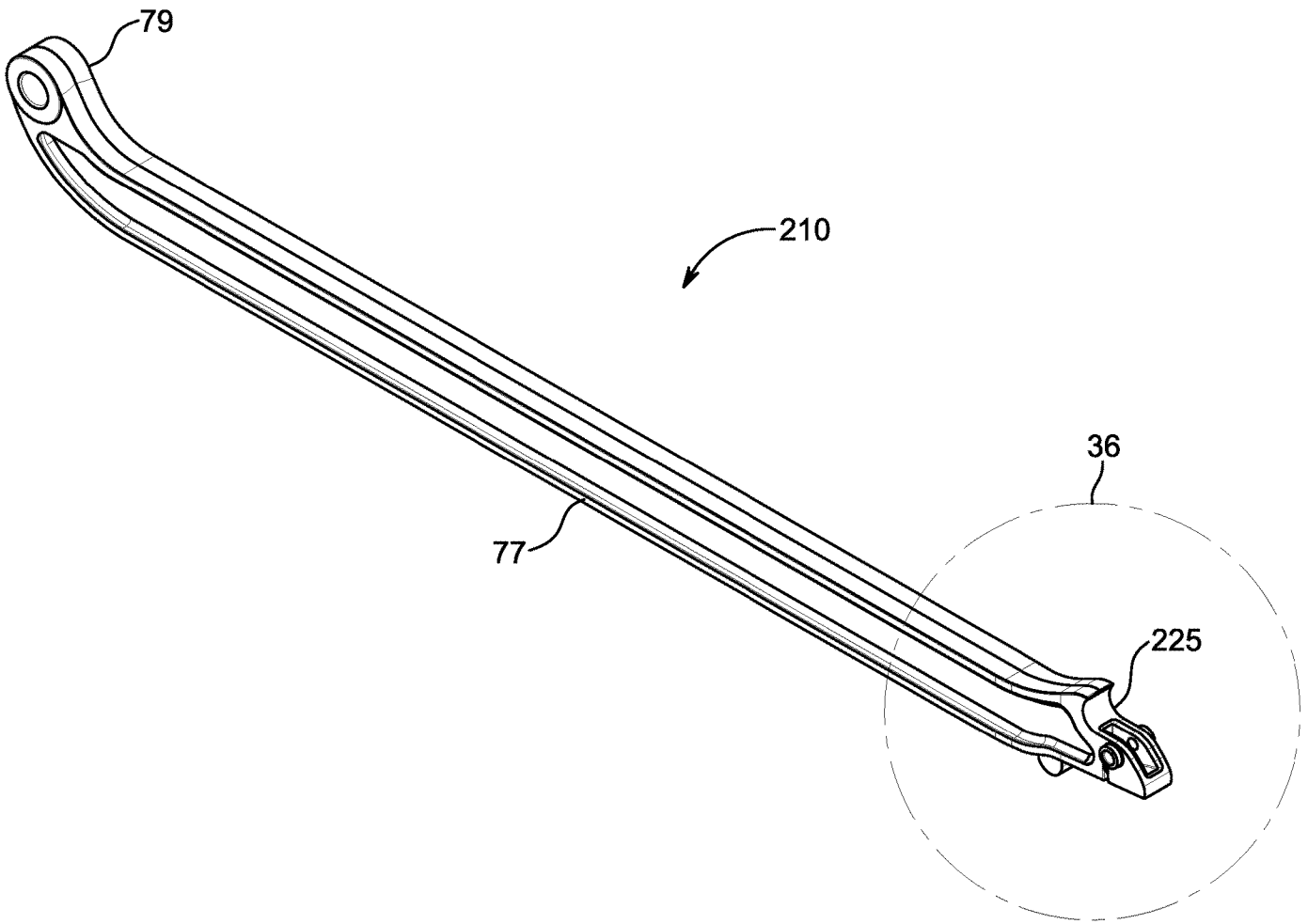
FIG. 35 is a perspective view of a lever of the cocking linkage assembly shown in FIG. 33, in accordance with an embodiment of the present disclosure.

FIG. 35 is a perspective view of a lever 210 of the cocking linkage assembly 200 shown in FIG. 33, in accordance with an embodiment of the present disclosure. Similar to the lever 75 shown in FIG. 7, the lever 210 of the cocking linkage assembly 200 transmits a substantial portion of the force applied by a user at the barrel 40 to the air piston assembly 55 via the shoe 220. The lever 210 can be rotated through an angle of approximately 11.5 degrees, for example, from a lever position parallel to the compression cylinder 50, to load the air piston assembly 55 within the compression cylinder 50. The lever 210 can be made from a number of materials, including carbon steel, stainless steel, and zinc. In an example embodiment, the lever 210 is manufactured from a zinc-alloy using a die-cast process. In some embodiments, the lever 210 can include a protective finish, such as electrocoat finish. As can be seen, the lever 210 includes a body 77 with a first end 79 and a second end 225. The body 77 and first end 79 have been previously described herein in relation to lever 75.

Figure 36:
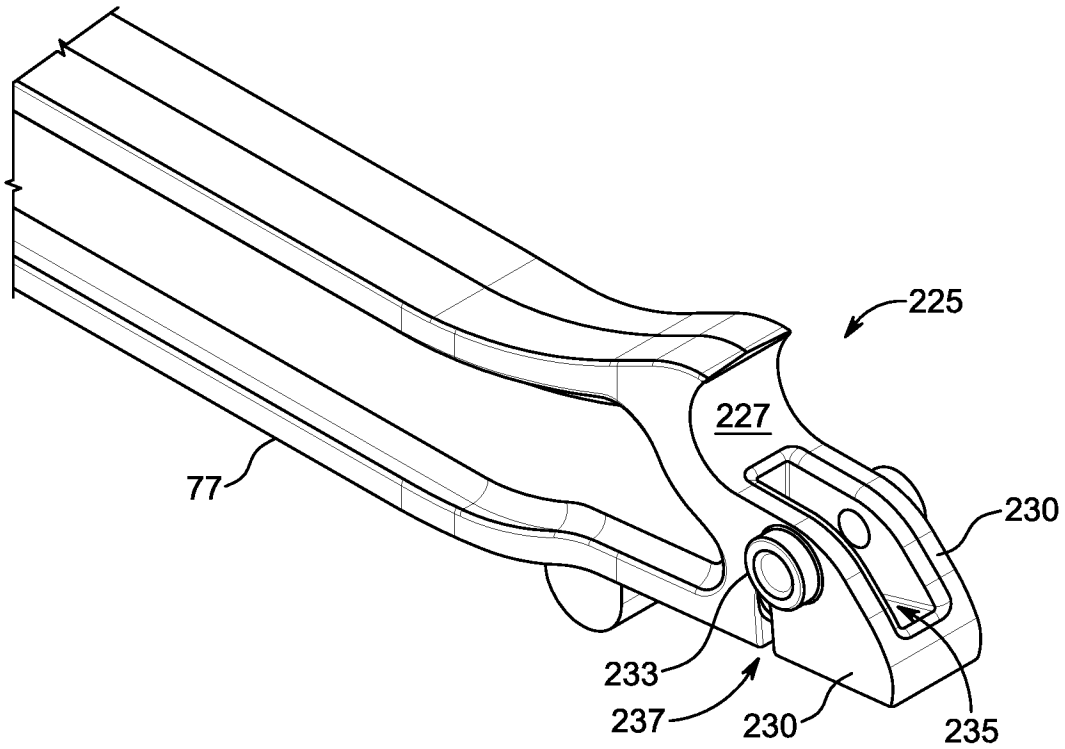
FIG. 36 is an enlarged view of the one end of the lever shown in FIG. 35, in accordance with an embodiment of the present disclosure.
Figure 37:
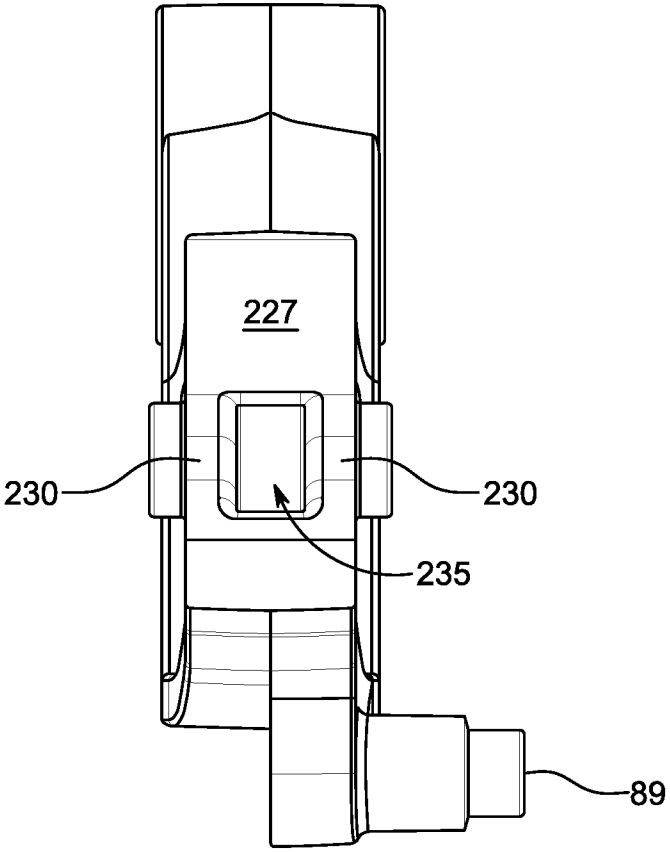
FIG. 37 is an end view of the one end of the lever shown in FIG. 36, in accordance with an embodiment of the present disclosure.

FIG. 36 is an enlarged view of one end of the lever 210 shown in FIG. 35, in accordance with an embodiment of the present disclosure. FIG. 37 is an end view of the one end of the lever 210 shown in FIG. 36. As can be seen, the lever 210 further includes a second end 225 that is disposed on the body 77 at an end opposing the first end 79. The second end 225 is configured to rotate about the shoe 220 and transmit the force applied by the user at the barrel 40 to the shoe 220. The angle of rotation of the body 77 about the shoe 220 can be, for example, greater than 10 degrees, greater than 15 degrees, greater than 20 degrees, greater than 25 degrees, less than 45 degrees, less than 35 degrees or less than 25 degrees from a lever position parallel to the compression cylinder 50. The second end 225 includes an attachment point 89, a lever bearing surface 227, supports 230, a recess 235, and a channel 237. The attachment point 89 has been previously described herein in relation to FIGS. 8 and 9.

The second end 225 of lever 210 includes a lever bearing surface 227. The lever bearing surface 227 is to receive or otherwise mate with a corresponding curved surface on the shoe 220 (e.g., a convex shoe pivot bearing surface). As the lever 210 is rotated, the lever bearing surface 227 can slide along the corresponding surface of the shoe 220 in a manner similar to the surfaces of bushing-bearings or ball-joint connections. Thus, the lever bearing surface 227 is in tangential contact with the corresponding curved surface of the shoe 220 to transmit the load from the lever 210 to the shoe 220 in a similar fashion as previously described for bearing surface 88. In an example embodiment, the lever bearing surface 227 is a concave surface. In some other embodiments, the lever bearing surface 227 can be a convex surface that is configured to be received in a concave surface of the shoe 220. The lever bearing surface 227 can have a surface area ranging from 10 to 80 square (sq.) mm, depending on a given application. In some embodiments, the lever bearing surface 227 can include a rolling element bearing in which case the two adjoining radial surfaces do not slide in relation to each other.

As can be seen, the lever bearing surface 227 is located above the supports 230 that receive pin 67. Since lever bearing surface 227 is not concentric with the pin 67 the force transmitted by the lever bearing surface 227 is distributed across the surface area of the corresponding curved surface of the shoe 220, and not applied to the pin 67. In an example embodiment, the lever bearing surface 227 is a concave surface configured to receive a convex surface of the shoe 220. In more detail, lever bearing surface 227 can be a concave surface in the form of radius feature machined or otherwise formed in the second end 225. In an example embodiment, the bearing surface has a radius from 2-4 mm, such as 3.15 mm. In some embodiments, lever bearing surface 227 can be a convex surface. The lever bearing surface 227, in other embodiments, can also be configured such that its cross section is a combination of angled, rounded, contoured, tapered, or flat profiles that can be received by or otherwise engage a corresponding surface of the lever 210. When configured as a combination of surfaces, the shoe pivot bearing surface 263A of the shoe 220 can also limit or otherwise prevent movement of the lever 210 relative to the shoe 220 in an axial direction, as previously described herein in relation to shoe 90. In some other embodiments, the lever bearing surface 227 can be a convex or concave surface having a cross section that includes angled, rounded, contoured, tapered, or flat profile features. Other bearing surface configurations will be apparent in light of the present disclosure.

Adjacent to the lever bearing surface 227 are supports 230. Each support 230 is configured to receive a pin (e.g., pin 76) to secure the lever 210 to the shoe 220. In addition, each support 230 may also be configured to receive the spring 215. In more detail, each support 230 can include a projection 233 on which the spring 215 is mounted to or otherwise installed thereon. To facilitate the installation of the spring 215, the second end 225 may also include a channel or groove 237. The channel 237 allows a portion of the spring 215 to be recessed within the lever 210, as shown in FIG. 34. In an example embodiment, the channel 237 may be recessed in a bottom surface of the lever 210 and in a direction normal to the supports 230. As can be seen, the supports 230 can also be curved or otherwise tapered to provide clearance to allow the lever 210 rotate about the shoe 220. Furthermore, supports 230 also define a recess 235 to receive a portion of the shoe 220 that engages or otherwise interfaces the pin 76. When assembled, the supports 230, the pin 76, and spring 215 prevent the lever 210 from disengaging or otherwise decoupling from the shoe 220. Furthermore, the pin 76 is positioned below the lever bearing surface 227, and thus the pin 76 can move with the lever 210 as it rotates about the shoe 220. As can be seen, the pin 76 is not at a location where it can contact the shoe pivot bearing surface 263A of the shoe 220.

Figure 38:
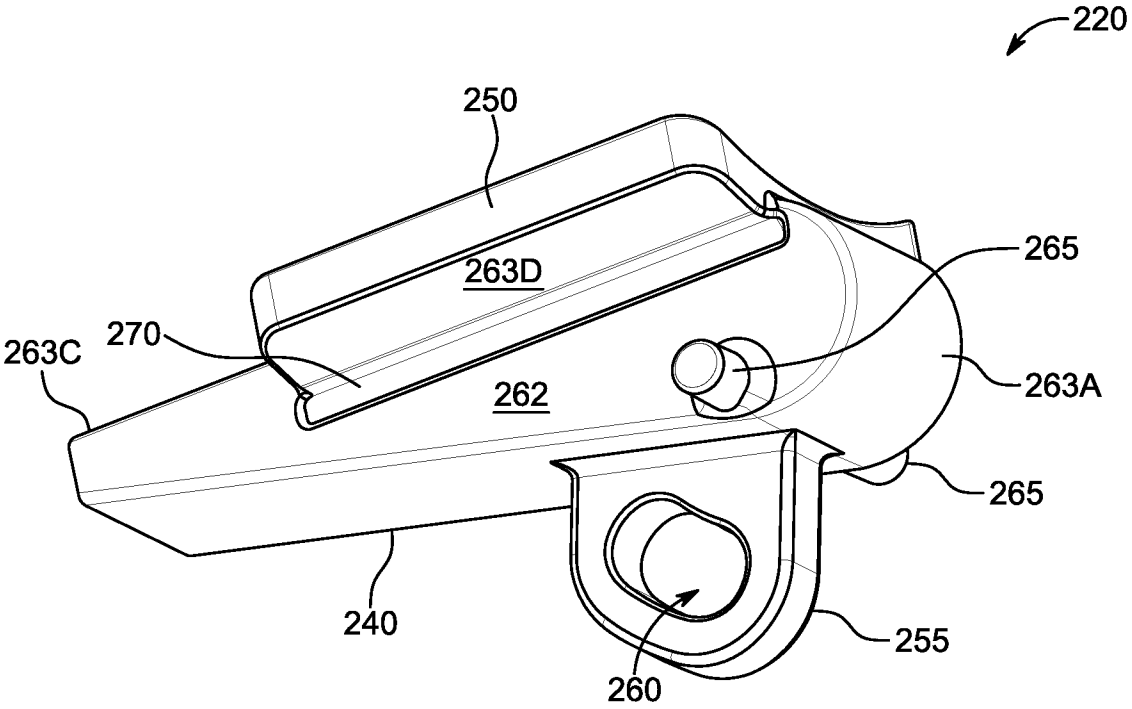
FIG. 38 is a perspective view of a shoe of the cocking linkage assembly of FIG. 33, in accordance with an embodiment of the present disclosure.
Figure 39:
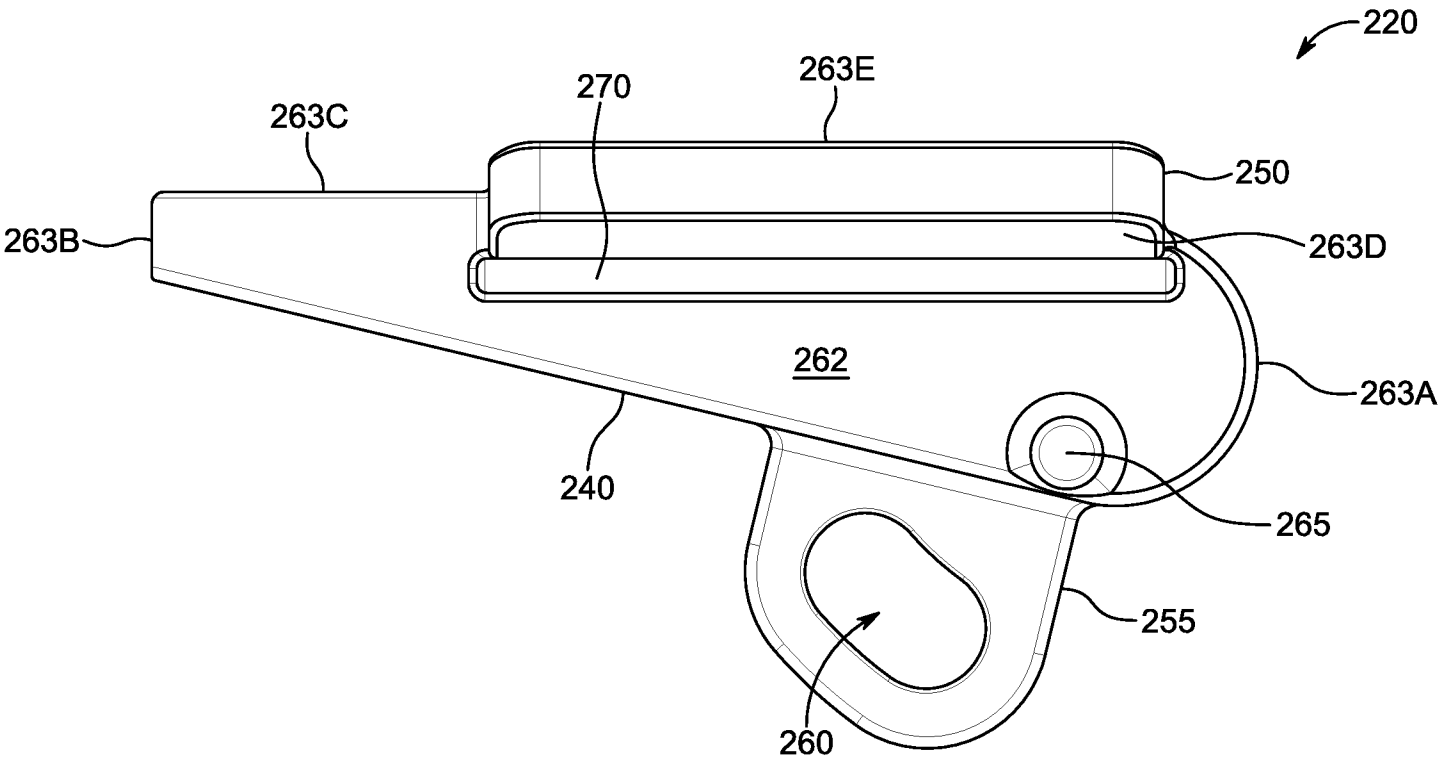
FIG. 39 is a side view of the shoe shown in FIG. 38, in accordance with an embodiment of the present disclosure.
Figure 40:
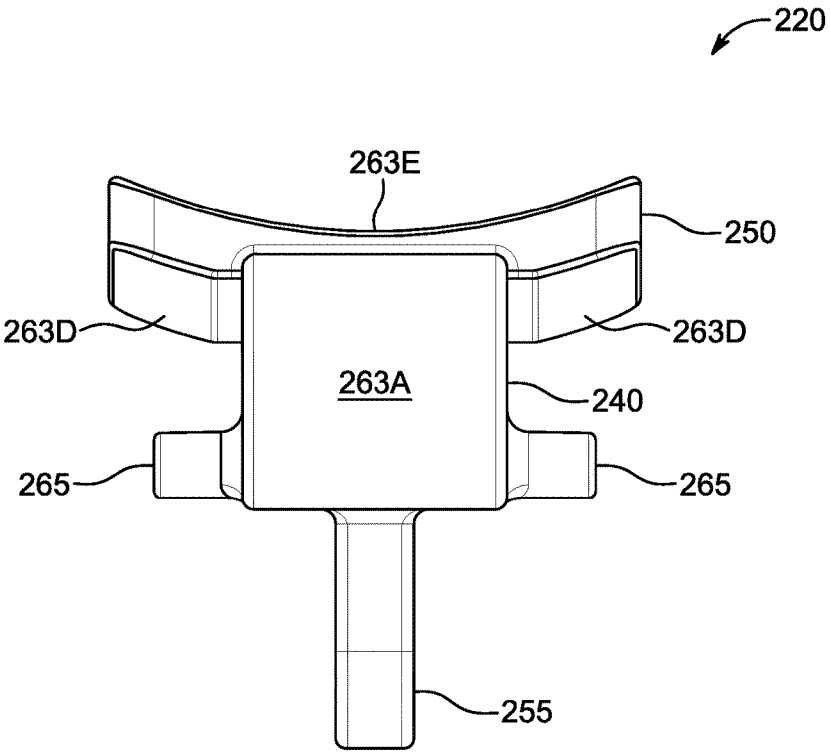
FIG. 40 is a front view of the shoe shown in FIG. 38, in accordance with an embodiment of the present disclosure.
Figure 41:
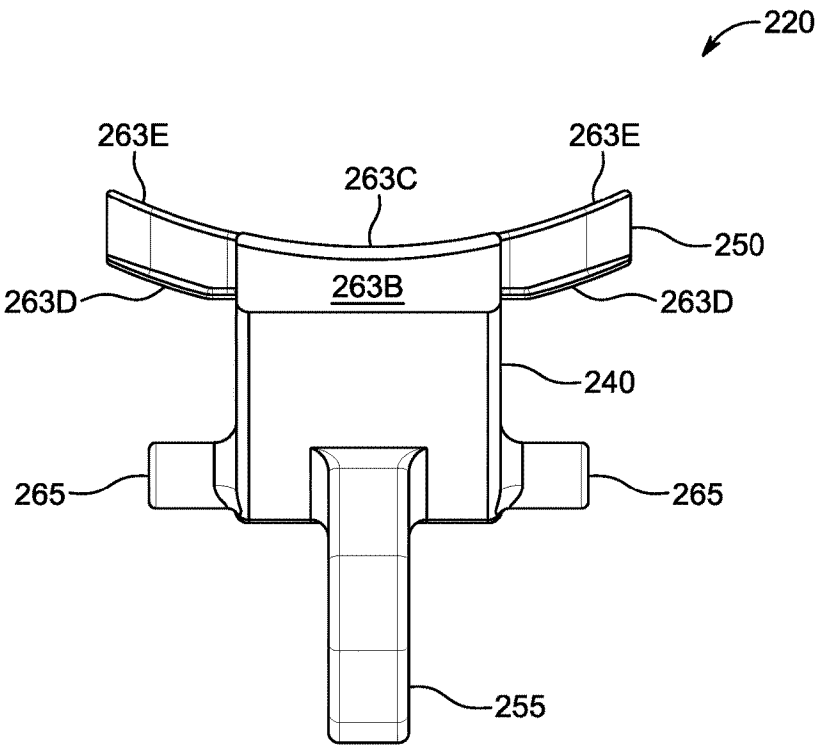
FIG. 41 is a rear view of the shoe shown in FIG. 38, in accordance with an embodiment of the present disclosure.

FIG. 38 is a perspective view of a shoe 220 for the cocking linkage assembly 200 of FIG. 33, in accordance with an embodiment of the present disclosure. FIG. 39 is a side view of the shoe 220 shown in FIG. 38. FIG. 40 is a front view of the shoe 220 shown in FIG. 38. FIG. 41 is a rear view of the shoe 220 shown in FIG. 38. The shoe 220 is attached to and can rotate ab out the lever 210. The shoe 220 can move within the compression cylinder 50 to load the air piston assembly 55 in a fashion similar to the one previously described in relation to shoe 90. The shoe 220 can be manufactured from materials, such as carbon steel or stainless steel, that can withstand the forces applied by the lever 210 and air piston assembly 55 as the air gun 10 is positioned in the ready-to-fire position. In an example embodiment the shoe 220 includes a base member 240 and a top member 250 disposed thereon. Base member 240 and top member 250 include a shoe pivot bearing surface 263A, a shoe end bearing surface 263B, a shoe tongue bearing surface 263C, shoe bottom bearing surfaces 263D, and shoe body bearing surface 263E (collectively bearing surfaces 263) that contact components of the air gun 10, such as the lever 210, air piston assembly 55, and compression cylinder 50. Some of these bearing surfaces (e.g., bearing surfaces 263A and 263B) transmit forces from the lever 210 to move the air piston assembly 55 to a ready-to-fire position, thereby compressing a spring disposed within the compression cylinder 50.

The base member 240 supports the top member 250 and is configured to attach to the lever 210. In addition, the base member 240 is further configured to interface with the piston assembly 55 to allow it to rotate within compression cylinder 50. Base member 240 can also position the assembly 55 horizontally in the compression cylinder 50, as will be described further herein. In an example embodiment, the base member 240 includes an extension member 255 having a slot 260, projections 265, and grooved and/or flat features 270 (hereinafter referred to as features 270). The base member 240 also includes shoe pivot bearing surface 263A along which the lever 210 slides or rotates. Since the pin 76 is located below the lever bearing surface 227 on the second end 225 of the lever 210, the base member 240 includes the extension member 255 to receive the pin 76. The extension member 255, in an example embodiment, is attached to a bottom surface of the shoe 220 at one end. As can be seen, the opposing end of the extension member 255 can be tapered or include one or more radius features to provide clearance with the second end 225 of the lever 210. Within the extension member 255 is a slot 260 configured to receive pin 76. In a general sense note that the slot 260 is configured to allow the pin 76 move as the lever 210 rotates about the shoe 220. In an example embodiment, the slot 260 is a semi-circular slot that is machined or otherwise formed concentric with the semi-cylindrical shoe pivot bearing surface 263A. In more detail, the slot 260 is concentric about a point that is the center of a circle in which defines the shoe pivot bearing surface 263A. For instance, the center of the slot can be at a radius 5-8 mm, such as 6.75 mm, from the center of the shoe pivot bearing surface 236A within the base member 240. The slot 260 begins at approximately 35.2 degrees from vertical reference line passing through the point that is the center of a circle that defines the shoe pivot bearing surface 263A. The slot 260 can have a length that is sufficient to enable the pin 76 to move therein during the range of rotation for the lever 210. In some embodiments, the slot 260 can have a length that spans an angle from 10-20°, such as 15°. In other embodiments, the slot 260 can have a length that spans an angle from 5° to 45°. Note, that the slot 260 is configured so that the pin 76 does not contact the edges of the slot as the lever 210 is rotated backward. Thus, the shoe 220 receives the force from the lever 210, and not the pin 76. As the lever 210 is rotated forward, the pin 76 contacts the forward end of the slot 260 causing the shoe 220 to move forward within the compression cylinder 50. Note, however, when the air gun 10 is in the ready-to-fire position, the pin 76 is near the end of the slot 260 in which the pin 76 contacted (or nearly contacted) to retract the shoe 220 within the compression cylinder 50.

Adjacent to the extension member 255 is the shoe pivot bearing surface 263A. In an example embodiment, the bearing surface 263A is a convex surface that contacts the lever bearing surface 227 of the lever 210. Thus, shoe pivot bearing surface 263A is the area on which the force of the lever 210 is applied to the shoe 220. The shoe pivot bearing surface 263A can have a surface area ranging from 10 to 80 sq. mm, depending on a given application. The shoe pivot bearing surface 263A can be a curved surface that defines an arc of 170 degrees about the point that is the center of a circle that defines the shoe pivot bearing surface 263A. In other embodiments, the shoe pivot bearing surface 263A can be a profile surface that extends between 50 and 180 degrees about the point that is the center of a circle that defines the shoe pivot bearing surface 263A. In some other embodiments, the shoe pivot bearing surface 263A is a concave surface configured to receive a convex surface of the lever 210. The shoe pivot bearing surface 263A can also be configured such that its cross section is a combination of angled, rounded, contoured, tapered, or flat profiles that can be received by or otherwise engage a corresponding surface of the lever 210. When configured as a combination of surfaces, the shoe pivot bearing surface 263A can also limit or otherwise prevent movement of the lever 210 relative to the shoe 220 in an axial direction, as previously described herein in relation to shoe 90. In some other embodiments, the shoe pivot bearing surface 263A can be a convex or concave surface having a cross-sectional profile that includes angled, rounded, contoured, tapered, or flat profiles. The shoe pivot bearing surface 263A can be of the same material as the remainder of the shoe 220, such as carbon or stainless steel, or of a different material. In some embodiments, the shoe pivot bearing surface 263A can be treated (e.g., with a black oxide coating) or untreated (e.g., a bare metal surface). In other cases, the shoe pivot bearing surface 263A can be plated (e.g., by an electroplating process) with a material (e.g., nickel or nickel-copper) to prevent the surface 263A from damage (e.g., pitting scratches or wear) that can occur over time. When assembled together, the shoe pivot bearing surface 263A is in tangential contact with the lever bearing surface 227 of the lever 210. As a result, lever bearing surface 227 slides tangentially along shoe pivot bearing surface 263A in a similar fashion as previously described herein regarding the rotation of lever 75 about the shoe 90. In some embodiments, the shoe pivot bearing surface 263A, or portions thereof, can be machined with a radius that is smaller than a radius for the lever bearing surface 227 to prevent interference between these surfaces at their remote ends (e.g., near a beginning and an end of each curved surfaces). In some other embodiments, the shoe pivot bearing surface 263A can include a rolling element bearing. Numerous other bearing surface configurations will be apparent in light of the present disclosure.

On an opposing end of the base member 240, opposite the end that includes shoe pivot bearing surface 263A, is shoe end bearing surface 263B. The shoe end bearing surface 263B is configured to contact the air piston assembly 55 to move and compress a spring disposed in compression cylinder 50. In more detail, the shoe end bearing surface 263B is configured to contact a surface (e.g., a machined feature such as a shoulder or step) of the air piston assembly 55, causing it to move horizontally in the compression cylinder 50. In an example embodiment, the shoe end bearing surface 263B is a substantially vertical surface located along a rear surface of base member 240. The shoe end bearing surface 263B, in some embodiments, can include a radius at each end of the surface. In some other embodiments, the shoe end bearing surface 263B can be angled or otherwise sloped to position the shoe tongue bearing surface 236C and shoe body bearing surface 263E into closer contact with an outer surface of the piston 110 in response to the shoe end bearing surface 263B contacting the air piston assembly 55 to move it within the compression cylinder 50. As can be seen, the shoe end bearing surface 263B can be the entire leading rear surface of base member 240, but need not be in all cases. In some other embodiments, the shoe end bearing surface 263B may be a portion of the rear surface of base member 240, for example multiple smaller bearing surfaces along the rear surface.

The base member 240 further includes shoe tongue bearing surface 263C. The shoe tongue bearing surface 263C, together with shoe body bearing surface 263E of the top member 250, provide a smooth surface on which the shoe 220 contacts an outer surface of the piston 110 for movement of the shoe 220 along the piston 110. In an example embodiment, the shoe tongue bearing surface 263C is located adjacent to the top member 250 and opposite the surface of the base member 240 on which the extension member 255 is attached. For example, the shoe tongue bearing surface 263C is a top surface of a tongue that extends rearwardly from the base member 240 between shoe body portions. In combination, the shoe tongue bearing surface 263C and the shoe body bearing surface 263E define a top surface of the base member 240. In one embodiment, the shoe tongue bearing surface 263C and shoe body bearing surface 263E are continuous. As can be seen in FIG. 41, for example, the shoe tongue bearing surface 263C can be a curved surface shaped to receive the outer cylindrical surface of the piston 110 of the air piston assembly 55. In some embodiments, the shoe tongue bearing surface 263C is a surface machined with a radius from 12 to 16 mm.

Attached to the base member are projections 265 for supporting spring 215. In an example embodiment, the projections 265 contact or otherwise support the legs of the torsion spring 215, and in turn enables the spring 215 to maintain an applied force against the lever 210. As can be seen, the projections 265 are located on each side 262 of the base member 240 and extend in a direction normal to side 262. The projections 265 may extend less than 25 mm, less than 20 mm, less than 13 mm or less than 6 mm from each side 262. In some embodiments, each projection 265 may include a hole therein to receive one end of the spring 215. Numerous other projection configurations will be apparent in light of the present disclosure.

The base member 240 also includes clearance features 270, such as a slot, groove, channel, or other structure that provides clearance between the shoe 220 and the vertical surfaces 136 of the slot 134 of the compression cylinder 50. In an example embodiment, the clearance features 270 are flat and are located on each side 262 of the base member 240 along a bottom surface of the top member 250. As a result, the shoe 220 does not contact the edges of the slot 134 during cocking, which provides reduced friction between the shoe 220 and compression cylinder 50 during the cocking action. The clearance features 270, in some embodiments, can be machined features, such as a radius, and positioned adjacent to the top member 250. As can be seen in FIG. 38, for example, the clearance features 270 can be approximately the same length as the top member 250. Note that the clearance features 270 can have any width sufficient to provide clearance with the slot 134 of the compression cylinder 50. The clearance features 270, in an example embodiment, are machined with a width from 0.3 to 1.0 mm, such as 0.6 mm. In other embodiments, note that the edges of the slot within the compression cylinder 50 can be machined with a radius, and thus the shoe 220 may omit clearance features 270.

Attached to the base member 240 is a top member 250. The top member 250 supports the base member 240 and one end of the lever 210 in a similar fashion as the top member 94 of shoe 90 previously described herein. In addition, the top member 250 contacts the piston 110, and thereby allows the shoe 220 to move along an outer surface of the piston 110. In an example embodiment, the top member 250 is curved and mates with a surface of the air piston assembly 55 and an inner surface of the compression cylinder 50. In a general sense, note that the width of the top member 250 is to be wide enough to prevent the shoe 220 from falling through the slot 134 of the compression cylinder 50 in which the shoe 90 operates. As previously described herein in relation to shoe 90, the width of the top member 250, however, cannot be so large as to prevent the shoe 220 from being installed. The top member 250, in some embodiments, can have a width between 10 mm to 30 mm depending on the configuration of the air gun 10. In other embodiments, the top member 250 can be a ring which receives or otherwise surrounds an outer surface of the air piston assembly 55. As can be seen, the top member 250 includes bearing shoe bottom bearing surfaces 263D and shoe body bearing surfaces 263E.

The top member 250 includes shoe bottom bearing surfaces 263D configured to contact an inner surface of the compression cylinder 50. The shoe bottom bearing surfaces 263D support the shoe 220 and components attached thereto (e.g., one end of the lever 75). In addition, the shoe bottom bearing surfaces 263D provide a smooth surface with which to contact an inner surface of the compression cylinder 50 to reduce friction between the shoe 220 and the compression cylinder 50. In an example embodiment, the shoe bottom bearing surfaces 263D are curved surfaces that correspond to or otherwise mate with an inner surface of the compression cylinder 50. As can be seen, the shoe bottom bearing surfaces 263D can extend from one end of the top member 250 to the other, but may not extend the entire length of the shoe 220. In other embodiments, the shoe bottom bearing surfaces 263D may extend along only a portion of the surface (e.g., 25%, 50% or 75% of the total surface) or comprise multiple smaller bearing surfaces positioned along the top member 250.

The top member 250 further includes shoe body bearing surface 263E. Shoe body bearing surface 263E, together with shoe tongue bearing surface 263C of the base member 240, provide a smooth surface on which the shoe 220 contacts an outer surface of the piston 110 to allow the shoe 220 to move along the piston 110. In an example embodiment, the shoe body bearing surface 263E is located along a surface of the top member 250 opposite the shoe bottom bearing surfaces 263D. As can be seen, the shoe body bearing surface 263E can be a curved surface shaped to receive the outer cylindrical surface of the piston 110 for the air piston assembly 55. In some embodiments, the shoe body bearing surface 263E is a surface machined with a radius between 12 to 16 mm. In some embodiments, the shoe bottom bearing surface 263D can be considered an outer shoe surface since it is convex and constructed to contact the inner surface of the compression cylinder 50. Similarly, the shoe body bearing surface 263E can be considered an inner shoe surface since it is concave and configured to contact an outer surface of the piston 110, in accordance with some embodiments.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

What is claimed is:

1. An air gun comprising:

a barrel pivotally attached to a cylinder;

a linkage attached to the barrel and operatively coupled to a piston within the cylinder, the linkage including a lever having a first end and a second end, the first end of the lever attached to the barrel, and the second end including a first surface having a concave or convex shape, and a shoe operatively connected to the piston and attached to the lever, the shoe including a second surface having a concave or convex shape to receive the first surface of the second end of the lever;

a trigger mechanism configured to release the piston in response to operating the trigger mechanism; and wherein the shoe is configured to move with the lever through an entire stroke of the lever.

2. The air gun of claim 1, wherein the first surface of the lever slides along the second surface of the shoe as the lever is rotated.

3. The air gun of claim 1, wherein the first surface of the lever has a first radius that is equal to or larger than a second radius of the second surface of the shoe.

4. The air gun of claim 1, wherein at least one of the first surface of the lever and the second surface of the shoe includes a rolling element bearing.

5. The air gun of claim 1, wherein the lever and the shoe are independent of a stock attached to the cylinder.

6. The air gun of claim 1, wherein the lever has a length of greater than 200 millimeters.

7. The air gun of claim 1, wherein the lever is positioned at an angle of less than 25 degrees relative to a centerline of the cylinder during the entire stroke of the lever.

8. The air gun of claim 1, further including a pin connecting the lever and the shoe.

9. The air gun of claim 8, wherein the pin supports the second end of the lever and prevents the lever from separating from the shoe.

10. The air gun of claim 1, wherein the shoe includes a flat surface that is received within a keyway of the piston.

11. An air gun comprising:

a barrel pivotally attached to a cylinder;

a linkage attached to the barrel and operatively coupled to a piston within the cylinder, the linkage including a lever with a first end and a second end, the first end of the lever attached to the barrel, and a shoe disposed within the cylinder and attached to the second end of the lever, the shoe includes a curved surface in contact with a portion of an outer surface of the piston such that the piston can be rotated along the curved surface of the shoe; and a trigger mechanism disposed on the cylinder and configured to release the piston in response to operating the trigger mechanism.

12. The air gun of claim 11, wherein movement of the lever and the shoe are independent of a stock attached to the cylinder.

13. The air gun of claim 11, wherein the outer surface of the piston is a uniform cylindrical surface.

14. The air gun of claim 11, wherein the shoe moves along the outer surface to position the piston within the cylinder.

15. The air gun of claim 11, wherein the shoe slides to a forward position in the cylinder upon closing the barrel.

16. The air gun of claim 11, wherein the shoe includes a pair of bearing surfaces, each bearing surface is located along a bottom surface of the shoe and in contact with an inner surface of the cylinder.

17. The air gun of claim 16, wherein when the shoe moves through a slot within the cylinder, the pair of bearing surfaces interfaces with the inner surface of the cylinder on both sides of the slot.

18. The air gun of claim 17, wherein a portion of the slot includes an opening wider than an operational portion of the slot, the opening configured to receive the shoe so as to position the shoe within the cylinder.

19. The air gun of claim 17, wherein the slot includes one or more inside edges with a gap disposed therebetween.

20. The air gun of claim 19, wherein the shoe includes at least one of a pair of grooved features and flat features to prevent contact between the shoe and the one or more inside edges of the slot.

21. The air gun of claim 11, further comprising a bearing sleeve disposed on the piston, the bearing sleeve in contact with an inner surface of the cylinder.

22. The air gun of claim 21, wherein the bearing sleeve includes a split and a plurality of bearing surfaces, the plurality of bearing surfaces in contact with the inner surface of the cylinder.

23. The air gun of claim 21, wherein the bearing sleeve includes a split and a bearing surface, the bearing surface being a continuous surface disposed along an outer surface of the bearing sleeve and in contact with the inner surface of the cylinder.

* * * * *